US011433675B2

(12) United States Patent
Takahashi

(10) Patent No.: US 11,433,675 B2
(45) Date of Patent: Sep. 6, 2022

(54) MAINTENANCE DEVICE AND LIQUID DISCHARGE APPARATUS

(71) Applicant: Ricoh Company, Ltd., Tokyo (JP)

(72) Inventor: Kenta Takahashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/238,825

(22) Filed: Apr. 23, 2021

(65) Prior Publication Data

US 2021/0394516 A1 Dec. 23, 2021

(30) Foreign Application Priority Data

Jun. 17, 2020 (JP) ..... JP2020-104732

(51) Int. Cl.
*B41J 2/165* (2006.01)

(52) U.S. Cl.
CPC ..... *B41J 2/16505* (2013.01); *B41J 2/16511* (2013.01); *B41J 2/16523* (2013.01); *B41J 2/16552* (2013.01); *B41J 2002/16502* (2013.01)

(58) Field of Classification Search
CPC ..... B41J 2/16505; B41J 2/16511; B41J 2/16523; B41J 2/16552; B41J 2002/16502; B41J 2/16508
See application file for complete search history.

(56) References Cited

U.S. PATENT DOCUMENTS

| | | | | |
|---|---|---|---|---|
| 9,694,583 | B2 * | 7/2017 | Ozaki | B41J 2/16552 |
| 2016/0325550 | A1 | 11/2016 | Masaoka et al. | |
| 2019/0184709 | A1 | 6/2019 | Hasebe et al. | |
| 2019/0255854 | A1 | 8/2019 | Asano et al. | |
| 2020/0079091 | A1 | 3/2020 | Takahashi et al. | |

FOREIGN PATENT DOCUMENTS

| | | |
|---|---|---|
| JP | 8-150722 | 6/1996 |
| JP | 2013-056518 | 3/2013 |
| WO | WO2011/040146 A1 | 4/2011 |

* cited by examiner

*Primary Examiner* — Geoffrey S Mruk
(74) *Attorney, Agent, or Firm* — Xsensus LLP

(57) ABSTRACT

A maintenance device configured to maintain a head configured to discharge a first liquid, the maintenance device includes a cap configured to contact a nozzle surface of the head, a storage configured to store a second liquid to be supplied into the cap, a supply device configured to supply the second liquid into the cap, a receptacle configured to receive the second liquid supplied into and overflown from the cap, and a collection device configured to collect the second liquid received by the receptacle.

13 Claims, 20 Drawing Sheets

COMPARATIVE EXAMPLE

MAINTENANCE DEVICE AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2020-104732, filed on Jun. 17, 2020, in the Japan Patent Office, the entire disclosures of which is hereby incorporated by reference herein.

BACKGROUND

Technical Field

Aspects of the present disclosure relate to a maintenance device and a liquid discharge apparatus.

Related Art

A device that uses a head to discharge a liquid includes a maintenance device (maintenance and recovery mechanism) including a cap to cap a nozzle surface of the head to maintain a performance of the head.

The device supplies a cleaning liquid, an amount of which exceeds an inner volume of the cap, so that the cleaning liquid overflows the cap. Thus, the device cleans a portion of the cap contacting the nozzle surface of the head.

SUMMARY

In an aspect of this disclosure, a maintenance device configured to maintain a head configured to discharge a first liquid, the maintenance device includes a cap configured to contact a nozzle surface of the head, a storage configured to store a second liquid to be supplied into the cap, a supply device configured to supply the second liquid into the cap, a receptacle configured to receive the second liquid supplied into and overflown from the cap, and a collection device configured to collect the second liquid received by the receptacle.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
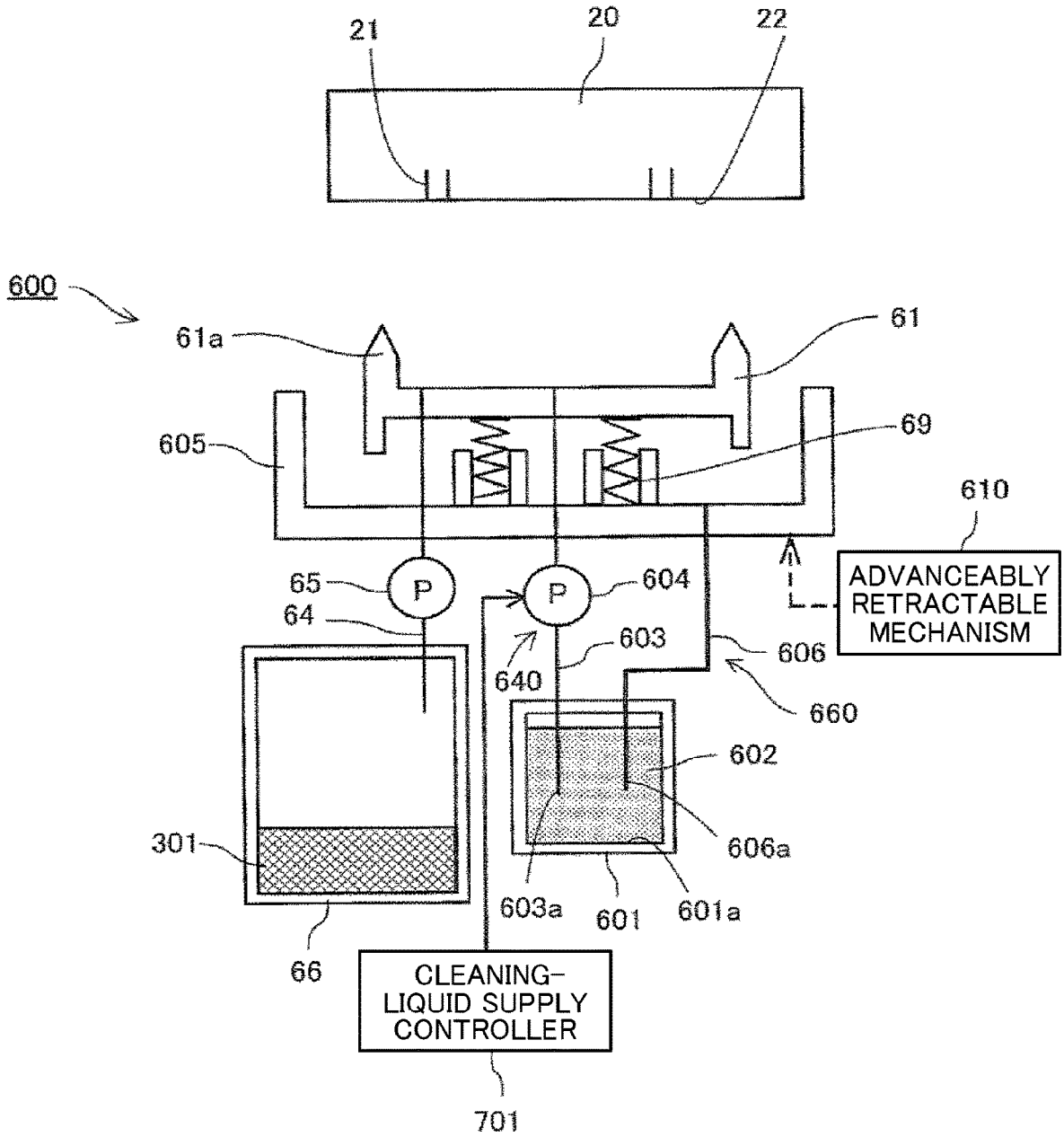
FIG. 1 is a schematic cross-sectional side view of a maintenance device according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Referring now to the drawings, wherein like reference numerals designate identical or corresponding parts throughout the several views, embodiments of the present disclosure are described below. A maintenance device 600 according to a first embodiment of the present disclosure is described with reference to FIG. 1.

FIG. 1 is a schematic cross-sectional side view of the maintenance device 600 according to a first embodiment of the present disclosure.

The maintenance device 600 includes a cap 61 (suction cap) to cap a nozzle surface 22 of the head 20. A plurality of nozzles 21 are arranged on the nozzle surface 22 of the head 20. A first liquid is discharged from the plurality of nozzles 21. Hereinafter, the first liquid is also referred to as "ink," and the "plurality of nozzles 21" is simply referred to as "nozzles 21" or "nozzle 21."

The cap 61 includes a contact part 61*a* (nip) that can come into contact with the nozzle surface 22 of the head 20 to cap the nozzle surface 22 of the head 20.

The cap 61 communicates with a waste-liquid storage 66 via a discharge channel 64. The waste-liquid storage 66 is a waste-liquid container to store a waste liquid 301 such as ink. The maintenance device 600 includes a suction pump 65 as a suction device in the discharge channel 64. The suction pump 65 sucks a liquid an interior of the cap 61.

The maintenance device 600 includes a cleaning-liquid storage 601 as a storage including a cleaning liquid container to store a cleaning liquid 602 (second liquid) to be supplied to the cap 61. The "cleaning liquid" is also referred to as a "second liquid."

Further, the maintenance device includes a cleaning-liquid supply device 640 as a supply device to supply the cleaning liquid 602 in the cleaning-liquid storage 601 to the cap 61 and return the cleaning liquid 602 remaining in the cap 61 to the cleaning-liquid storage 601.

The cleaning-liquid supply device 640 includes a cleaning-liquid supply channel 603 and a liquid feed pump 604. The cleaning-liquid supply channel 603 may include a tube, for example, as a supply channel (supply channel member) to connect the cleaning-liquid storage 601 and the cap 61. The liquid feed pump 604 such as a reversible pump is arranged in the cleaning-liquid supply channel 603.

The maintenance device 600 includes a cleaning-liquid receptacle 605 as a receptacle to receive the cleaning liquid 602 overflown from the cap 61. The cleaning-liquid receptacle 605 is arranged below the cap 61. The maintenance device 600 in the first embodiment includes the cleaning-liquid receptacle 605 that holds the cap 61 via an elastic member 69 such as a spring. The maintenance device 600 further includes an advanceably retractable mechanism 610 as an advanceably retractable device that moves the cleaning-liquid receptacle 605 and the cap 61 as a single body with respect to the head 20. Specifically, the advanceably retractable mechanism 610 advances the cleaning-liquid receptacle 605 and the cap 61 toward the head 20 or retracts the cleaning-liquid receptacle 605 and the cap 61 from the head 20. In FIG. 1, the cleaning-liquid receptacle 605 and the cap 61 moves in a vertical direction.

Further, the maintenance device 600 includes a cleaning-liquid collection device 660 as a collection device to collect the cleaning liquid 602 received from the cleaning-liquid receptacle 605. Further, the cleaning-liquid collection device 660 includes a cleaning-liquid collection channel 606 as a collection channel (collection channel member) to connect the cleaning-liquid receptacle 605 and the cleaning-liquid storage 601.

The cleaning-liquid collection channel 606 as a collection channel member includes a discharge port 606*a* disposed apart from an inner bottom 601*a* of the cleaning-liquid storage 601. Similarly, the cleaning-liquid supply channel 603 as a supply channel member includes an intake port 603*a* disposed apart from the inner bottom 601*a* of the cleaning-liquid storage 601.

The maintenance device 600 includes a cleaning-liquid supply controller 701 that drives the liquid feed pump 604 of the cleaning-liquid supply device 640 in a forward rotation to supply (feed) the cleaning liquid 602 into the cap 61 from the cleaning-liquid storage 601. Further, the cleaning-liquid supply controller 701 reversely drives the liquid feed pump 604 of the cleaning-liquid supply device 640 to return (reversely feed) the cleaning liquid 602 remaining in the cap 61 to the cleaning-liquid storage 601.

Next, an effect of the maintenance device 600 according the first embodiment is described with reference to FIGS. 2 to 4.

Figure 2:
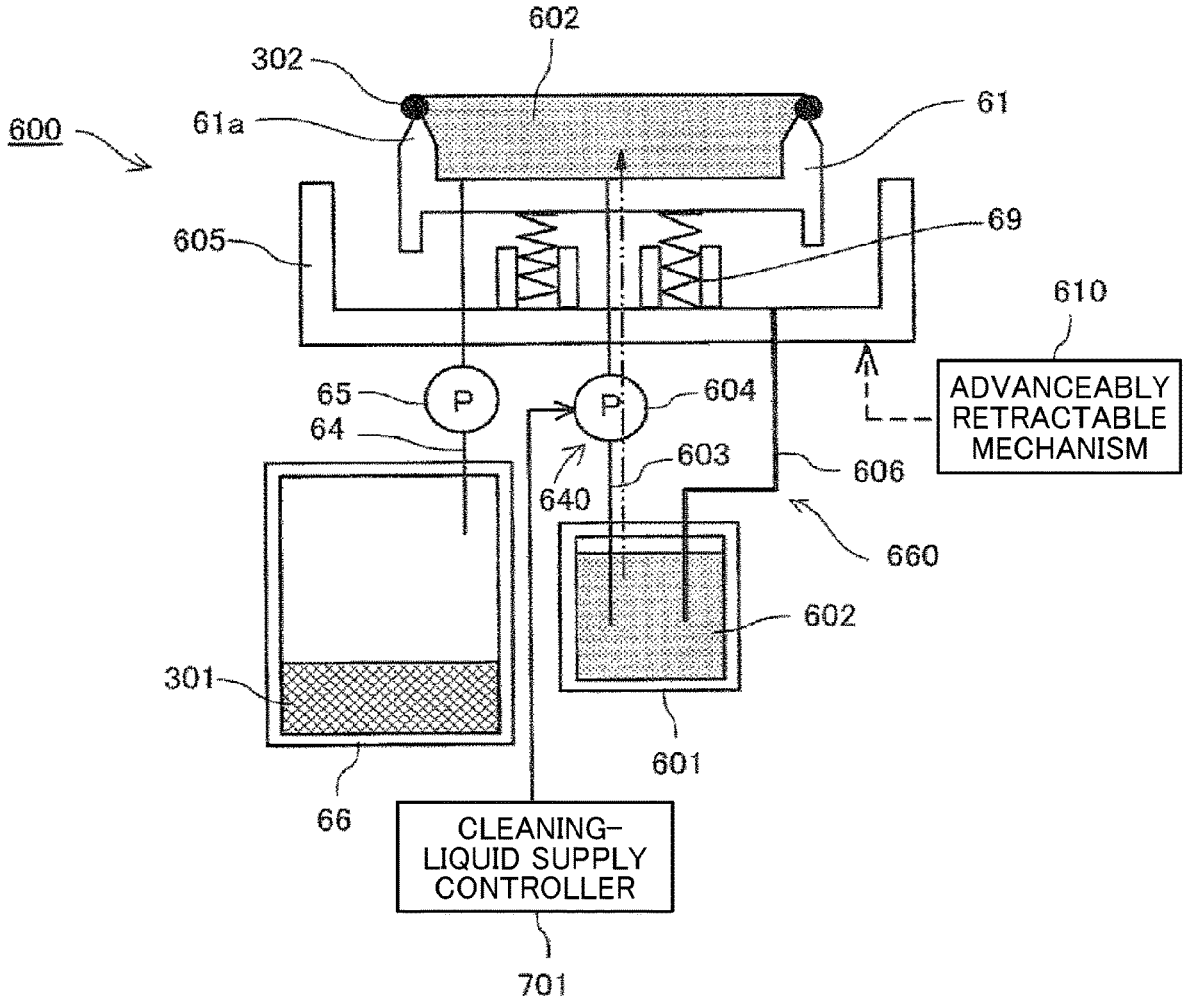
FIG. 2 is a schematic cross-sectional side view of the maintenance device illustrating an effect of the first embodiment.
Figure 3:
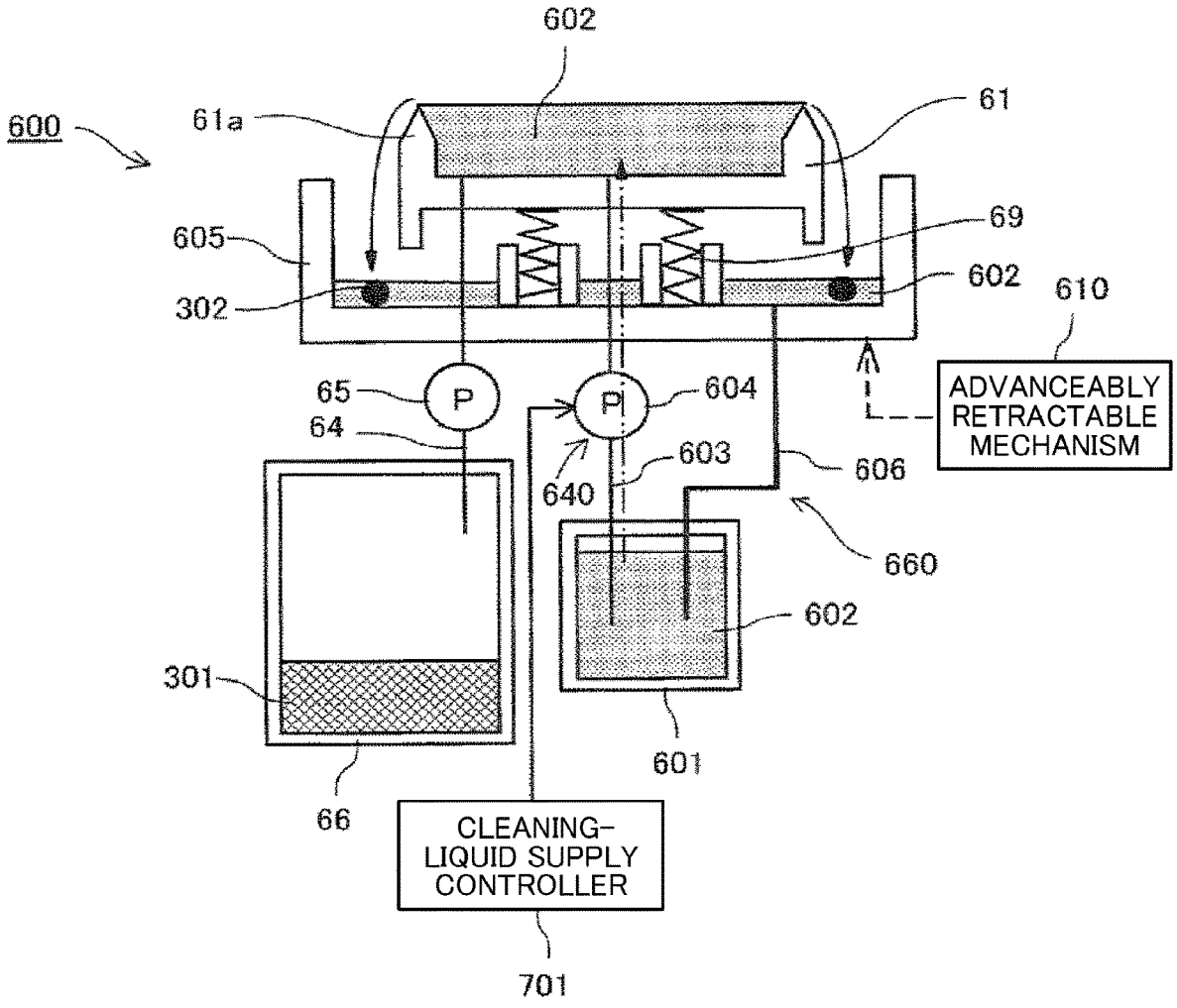
FIG. 3 is a schematic cross-sectional side view of the maintenance device illustrating the effect of the first embodiment.
Figure 4:
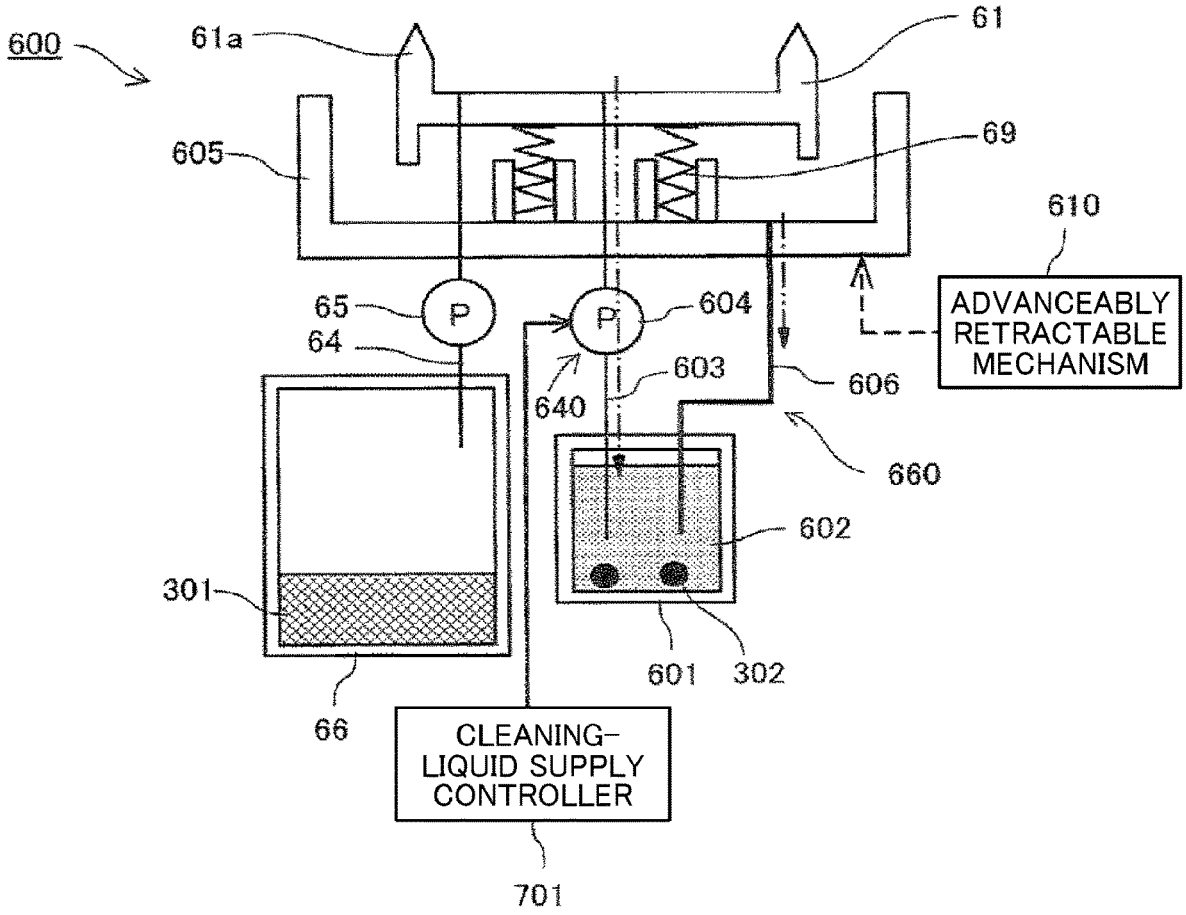
FIG. 4 is a schematic cross-sectional side view of the maintenance device illustrating the effect of the first embodiment.

FIGS. 2 to 4 are schematic cross-sectional side views of the maintenance device 600 illustrating the effect of the first embodiment.

The maintenance device 600 advances the cap 61 toward the nozzle surface 22 of the head 20 to bring the contact part 61*a* (nip) of the cap 61 into contact with the nozzle surface 22 of the head 20 to cap the nozzle surface 22 of the head 20 to maintain the head 20. The maintenance device 600 may move the head 20 and the cap 61 relative to each other. The maintenance device 600 may move the head 20 toward the cap 61. The maintenance device 600 may move one of the head 20 and the cap 61 toward another of the head 20 and the cap 61.

Then, maintenance device 600 drives the suction pump 65 to suck the space formed between the nozzle surface 22 of the head 20 and an interior of the cap 61 to suck and discharge the ink from the nozzle 21 into the cap 61. The above-described maintenance operation is also referred to as a "nozzle suction operation."

Then, the maintenance device 600 separates the cap 61 from the nozzle surface 22 of the head 20 to become a decapped state. Further, the maintenance device 600 drives the suction pump 65 to discharge the waste liquid 301 remaining in the cap 61 to the waste-liquid storage 66.

At the time of discharging the waste liquid, the ink may adhere to the contact part 61*a* of the cap 61 as an adhered substance 302 as illustrated in FIG. 2. The adhered substance 302 may grow over time and become a deposit.

The ink adhered to the contact part 61*a* of the cap 61 dries to become a thickened minute amount of adhered substance 302 and remains on the contact part 61*a*. With repetition of the nozzle suction operation, the adhered substance 302 on the contact part 61*a* of the cap 61 is solidified, accumulated, and grows to become the deposit.

When the cap 61 caps the nozzle surface 22 of the head 20 while the adhered substance 302 is attached to the contact part 61*a* of the cap 61, the adhered substance 302 on the contact part 61*a* of the cap 61 is transferred to the nozzle surface 22 of the head 20. Thus, a print surface of a recording medium may be soiled by the adhered substance 302 transferred on the nozzle surface 22 of the head 20 when the printer 1 scans the head 20 for a print operation.

Further, the adhered substance 302 is sandwiched between the contact part 61*a* of the cap 61 and the nozzle surface 22 of the head 20. Thus, capping between the contact part 61*a* of the cap 61 and the nozzle surface 22 of the head 20 becomes incomplete and may deteriorates moisturizing performance and suction performance of the cap 61.

Therefore, the maintenance device 600 in the first embodiment performs a cleaning operation to clean the cap 61 with the cleaning liquid 602 at a predetermined time. The cleaning-liquid supply controller 701 drives the liquid feed pump 604 in the forward rotation to supply the cleaning liquid 602 from the cleaning-liquid storage 601 into the cap 61 in a cleaning operation as illustrated in FIG. 2. A supply amount (liquid feed amount) of the cleaning liquid 602 is set to be larger than an inner volume of the cap 61 so that the cleaning liquid 602 overflows from the cap 61.

As a result, as illustrated in FIG. 3, the cleaning liquid 602 supplied to the cap 61 overflows beyond the contact part 61*a* of the cap 61. The cleaning liquid 602 overflowing from the cap 61 flushes the adhered substance 302 adhering to the contact part 61*a* of the cap 61. Then, the cleaning liquid 602 flowing over the contact part 61*a* of the cap 61 is received by the cleaning-liquid receptacle 605.

As illustrated in FIG. 4, the cleaning liquid 602 containing the adhered substance 302 is received by the cleaning-liquid receptacle 605 and is collected to the cleaning-liquid storage 601 through the cleaning-liquid collection channel 606. The maintenance device 600 in the first embodiment includes the cleaning-liquid storage 601 below the cleaning-liquid receptacle 605.

Thus, the cleaning liquid 602 in the cleaning-liquid receptacle 605 is collected to the cleaning-liquid storage 601 by head difference. Further, a device such as a liquid feed pump may be arranged in the cleaning-liquid collection channel 606 to forcibly collect the cleaning liquid 602 from the cleaning-liquid receptacle 605 to the cleaning-liquid storage 601.

After the cleaning liquid 602 overflows from the cap 61, the cleaning-liquid supply controller 701 stops driving the liquid feed pump 604 at a required timing to stop supplying the cleaning liquid 602 to the cap 61.

Then, the cleaning-liquid supply controller 701 reversely drives the liquid feed pump 604 to reversely feed the cleaning liquid 602 remaining in the cap 61 to the cleaning-liquid storage 601.

The maintenance device 600 performs the cleaning operation to clean the contact part 61*a* of the cap 61 so that the maintenance device 600 can prevent the adhered substance 302 adhering to the contact part 61*a* of the cap 61 from solidifying and accumulating on the contact part 61*a*.

Therefore, the maintenance device 600 can prevent the deposit of the adhered substance 302 remaining on the contact part 61*a* of the cap 61 from transferring to the nozzle surface 22 of the head 20. Thus, the maintenance device 600 can prevent a print surface of a recording medium from soiling by the adhered substance 302 transferred on the nozzle surface 22 of the head 20 when the printer 1 scans the head 20 for the print operation.

Further, the maintenance device 600 can prevent the adhered substance 302 from being sandwiched between the contact part 61*a* of the cap 61 and the nozzle surface 22 of the head 20. Thus, the maintenance device 600 can fully cap the nozzle surface 22 of the head 20 and prevent the cap 61 from deterioration of moisturizing performance and suction performance.

Thus, the maintenance device 600 can collect the cleaning liquid 602 used for cleaning the contact part 61*a* of the cap 61 so that the maintenance device 600 can reduce an amount of consumption of the cleaning liquid 602 for cleaning the cap 61.

Further, the maintenance device 600 does not discharge the cleaning liquid 602 used for cleaning the contact part 61*a* of the cap 61 to the waste-liquid storage 66 as it is as a waste liquid. Thus, the maintenance device 600 can reduce an amount of waste liquid stored in the waste-liquid storage 66 and lengthen life of the waste-liquid storage 66.

Next, an effect of a position of the discharge port 606*a* of the cleaning-liquid collection channel 606 and an effect of a position of the intake port 603*a* of the cleaning-liquid supply channel 603 is illustrated with reference to FIGS. 5 and 6.

Figure 5:
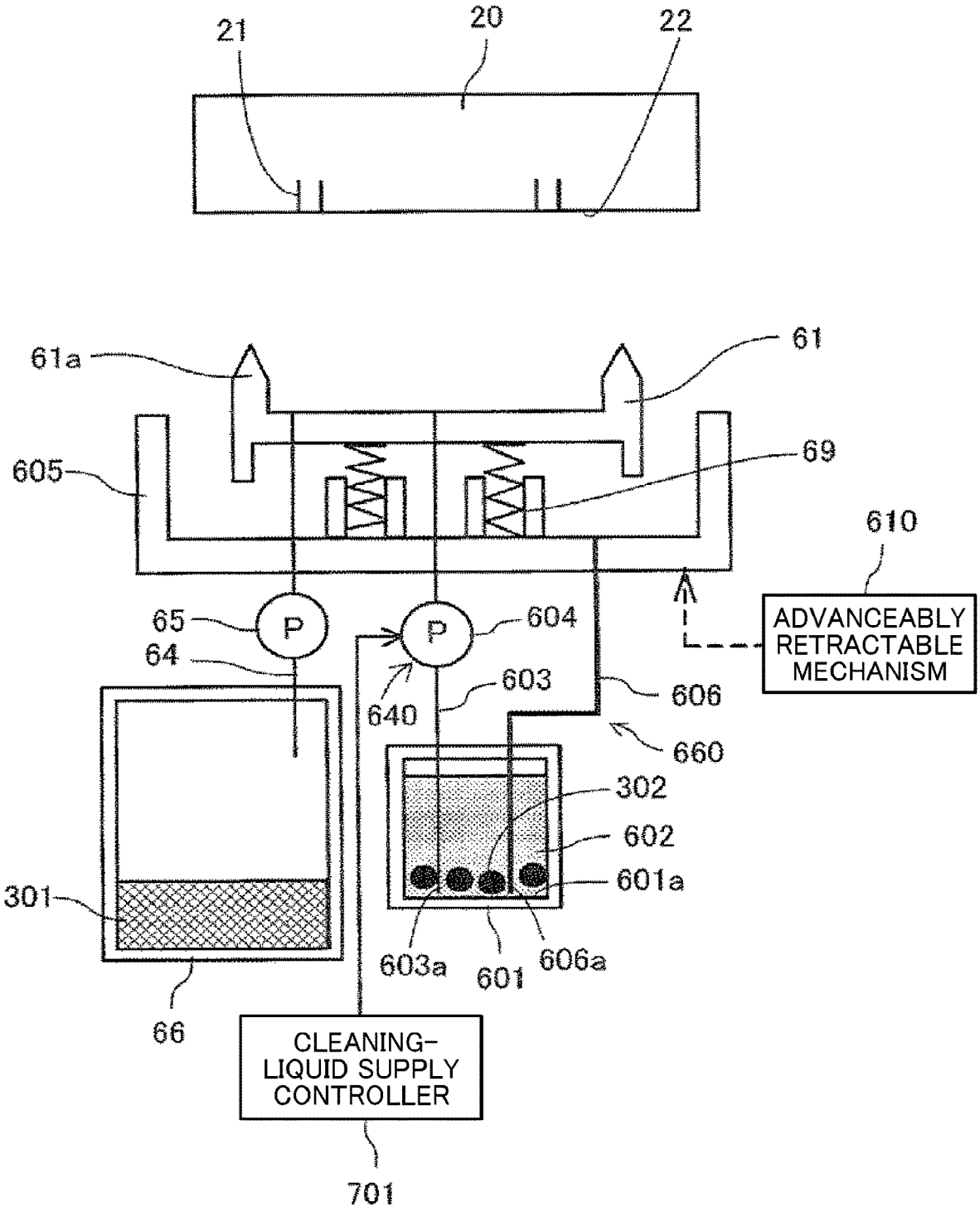
FIG. 5 is a schematic cross-sectional side view of the maintenance device in an example in which a discharge port of a cleaning-liquid collection channel and an intake port of a cleaning-liquid supply channel are extended to an inner bottom of a cleaning-liquid storage.

FIG. 5 is a schematic cross-sectional side view of the maintenance device 600 in an example in which the discharge port 606*a* of the cleaning-liquid collection channel 606 and the intake port 603*a* of the cleaning-liquid supply channel 603 are extended to the inner bottom 601*a* of a container of the cleaning-liquid storage 601.

Figure 6A:
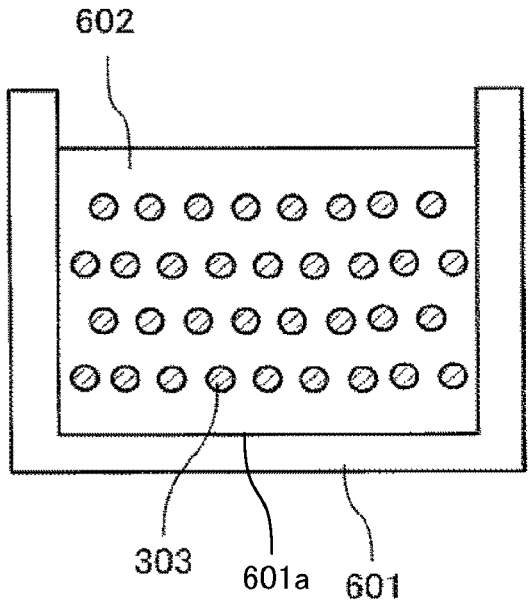
FIGS. 6A and 6B are schematic side views of the cleaning-liquid storage to illustrate sedimentation of an adhered substance collected to the cleaning-liquid storage.
Figure 6B:
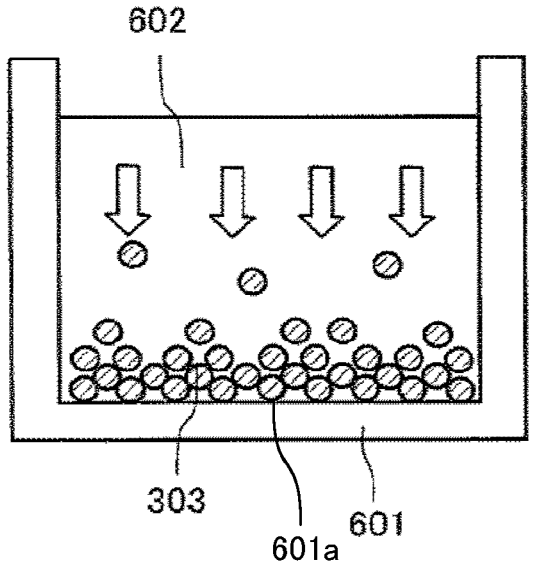

FIGS. 6A and 6B are schematic side views of the cleaning-liquid storage 601 to illustrate sedimentation of the adhered substance 302 collected to the cleaning-liquid storage 601.

As described above, the maintenance device 600 in the first embodiment includes the discharge port 606*a* of the cleaning-liquid collection channel 606 and the intake port 603*a* of the cleaning-liquid supply channel 603 in the cleaning-liquid storage 601.

The cleaning-liquid supply channel 603 includes the intake port 603*a* from which the cleaning liquid 602 (second liquid) in the cleaning-liquid storage 601 is taken in. The cleaning-liquid collection channel 606 includes the discharge port 606*a* from which the cleaning liquid 602 (second liquid) received from the cleaning-liquid receptacle 605 is discharged to the cleaning-liquid storage 601.

The intake port 603*a* and the intake port 603*a* are arranged apart (separated) from the inner bottom 601*a* of the cleaning-liquid storage 601.

Thus, the maintenance device 600 in the first embodiment washes away the adhered substance 302 generated by ink or the like with the cleaning liquid 602 and collects the cleaning liquid 602 containing the adhered substance 302 to the cleaning-liquid storage 601.

As illustrated in FIG. 6A, a sediment 303 (precipitate) such as the pigment component and the adhered substance 302 of the ink collected in the cleaning-liquid storage 601 is accumulated in the cleaning-liquid storage 601 according to progress of collection and reuse of the cleaning liquid 602.

Then, the sediment 303 settles and accumulates on the inner bottom 601*a* of the container of the cleaning-liquid storage 601 over time as illustrated in FIG. 6B.

Therefore, if the discharge port 606*a* of the cleaning-liquid collection channel 606 and the intake port 603*a* of the cleaning-liquid supply channel 603 are arranged in contact with or close to the inner bottom 601*a* of the container of the cleaning-liquid storage 601 as illustrated in FIG. 5, the sediment 303 may clog the discharge port 606*a* and the intake port 603*a*.

Therefore, the discharge port 606*a* of the cleaning-liquid collection channel 606 and the intake port 603*a* of the cleaning-liquid supply channel 603 are disposed apart (separated) from the inner bottom 601*a* of the container of the cleaning-liquid storage 601 to prevent the discharge port 606*a* and the intake port 603*a* from clogging by the sediment 303.

Next, a second embodiment of the present disclosure is described with reference to FIG. 7.

Figure 7:
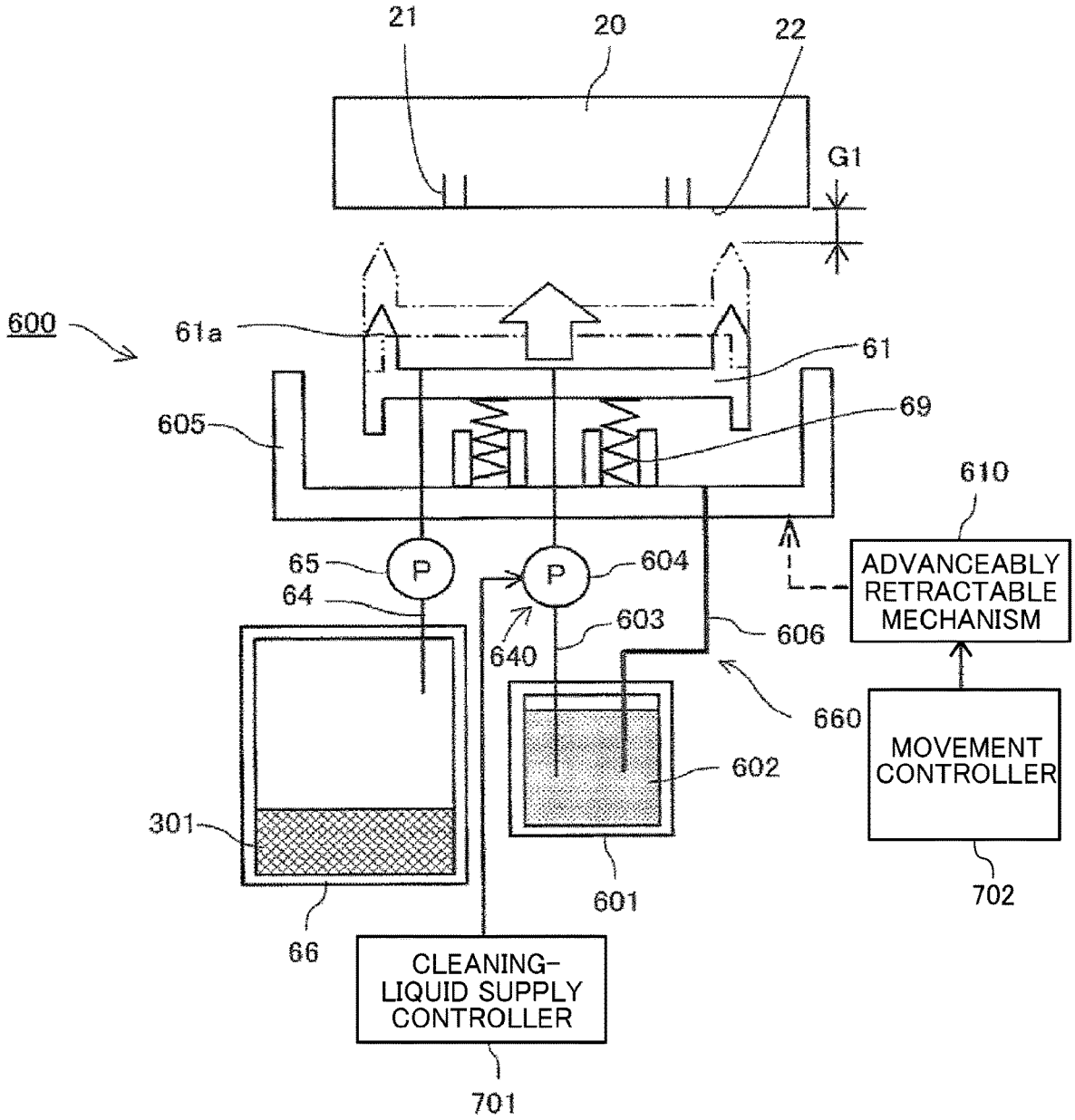
FIG. 7 is a schematic cross-sectional side view of a maintenance device according to a second embodiment of the present disclosure.

FIG. 7 is a schematic cross-sectional side view of the maintenance device 600 according to the second embodiment of the present disclosure.

The maintenance device 600 in the second embodiment includes a movement controller 702 (circuitry) to drive and control an advanceably retractable mechanism 610. The advanceably retractable mechanism 610 advances the cap 61 toward and retracts the cap 61 from the nozzle surface 22 of the head 20 together with the cleaning-liquid receptacle 605. The nozzle surface 22 of the head serves as an opposing member.

When the maintenance device 600 performs the cleaning operation of the cap 61, the movement controller 702 (circuitry) drives and controls the advanceably retractable mechanism 610 to control to advanceably move the cap 61 to a position at which the cap 61 faces the nozzle surface 22 of the head 20 with a predetermined gap G1.

Here, a position indicated by a solid line of the cap 61 in FIG. 7 is referred as a "decapped position."

Further, a position indicated by a phantom (double-dashed) line of the cap 61 in FIG. 7 is referred as a "cleaning position." Further, the predetermined gap G1 is set to a distance at which a surface tension of the cleaning liquid 602 is generated between the contact part 61*a* of the cap 61 and the nozzle surface 22 of the head 20.

Next, an effect of the maintenance device according to the second embodiment is described with reference to FIGS. 8 to 11.

FIGS. 8 to 11 are schematic cross-sectional side views of the maintenance device 600 illustrating the effect of the second embodiment.

Figure 8:
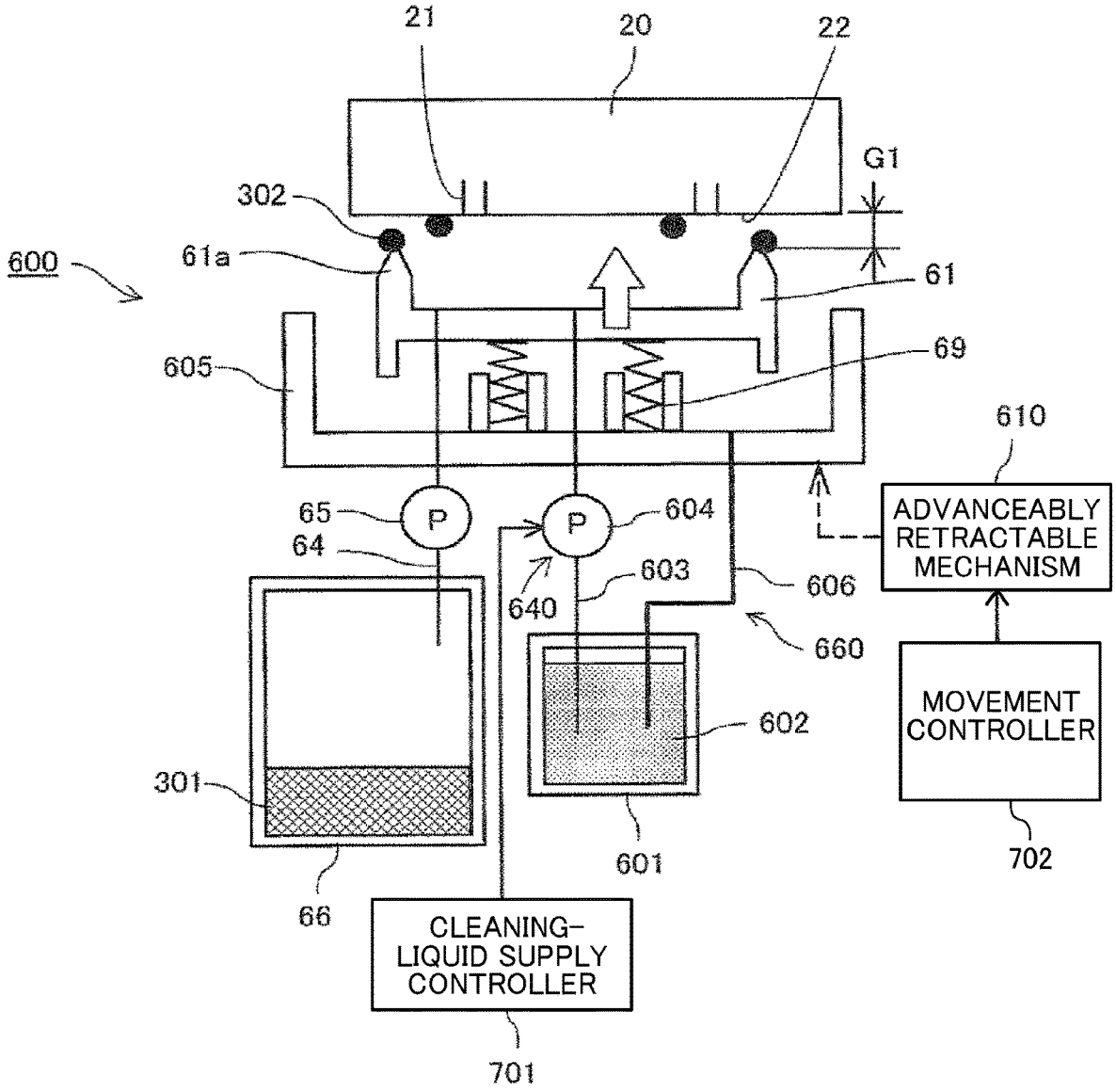
FIG. 8 is a schematic cross-sectional side view of the maintenance device illustrating an effect of the second embodiment.

The movement controller 702 (circuitry) controls the advanceably retractable mechanism 610 to advance the cap 61 toward the nozzle surface 22 of the head 20 in a vertically upward direction as indicated by arrow in FIG. 8 so that the cap 61 reaches the cleaning position at which there is the fap G1 between the contact part 61*a* of the cap 61 and the nozzle surface 22 of the head 20. The head 20 serves as the opposing member.

Figure 9:
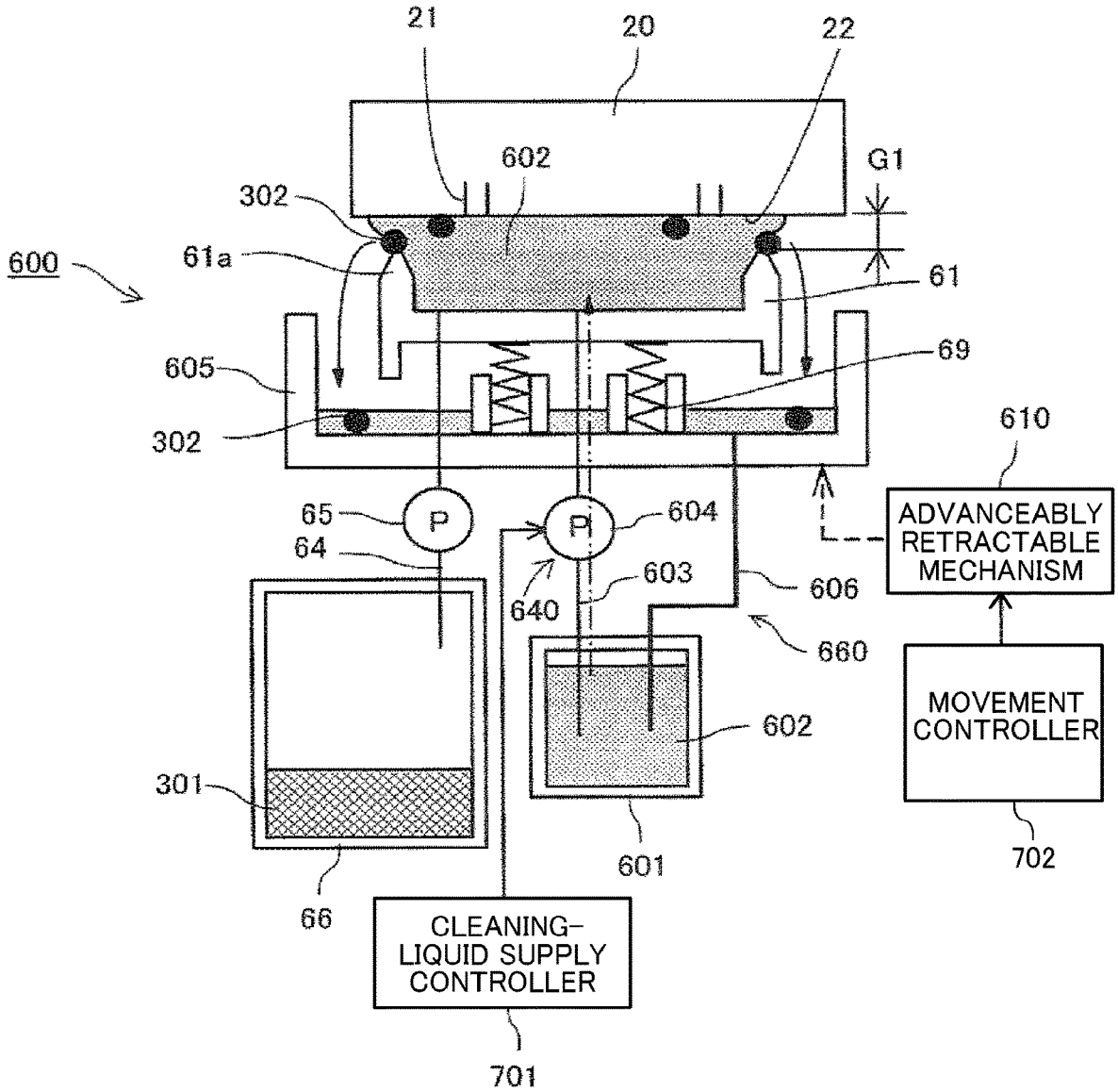
FIG. 9 is a schematic cross-sectional side view of the maintenance device illustrating an effect of the second embodiment.

The cleaning-liquid supply controller 701 drives the liquid feed pump 604 in the forward rotation to supply the cleaning liquid 602 from the cleaning-liquid storage 601 into the cap 61 in the cleaning operation as illustrated in FIG. 9. A supply amount (liquid feed amount) of the cleaning liquid 602 is set to be larger than an inner volume of the cap 61 so that the cleaning liquid 602 overflows from the cap 61.

As a result, the cleaning liquid 602 supplied to the cap 61 sticks to the nozzle surface 22 of the head 20 due to surface tension and overflows from the cap 61 through the gap G1 between the contact part 61*a* and the nozzle surface 22 to an exterior of the cap 61.

The cleaning liquid 602 overflowing from the cap 61 washes away the adhered substance 302 adhering to the contact part 61*a* of the cap 61. Further, the cleaning liquid 602 overflowing from the cap 61 washes the adhered substance 302 remaining on the nozzle surface 22 of the head 20 to clean the nozzle surface 22 of the head 20. Then, the cleaning liquid 602 flowing over the contact part 61*a* of the cap 61 is received by the cleaning-liquid receptacle 605.

Figure 10:
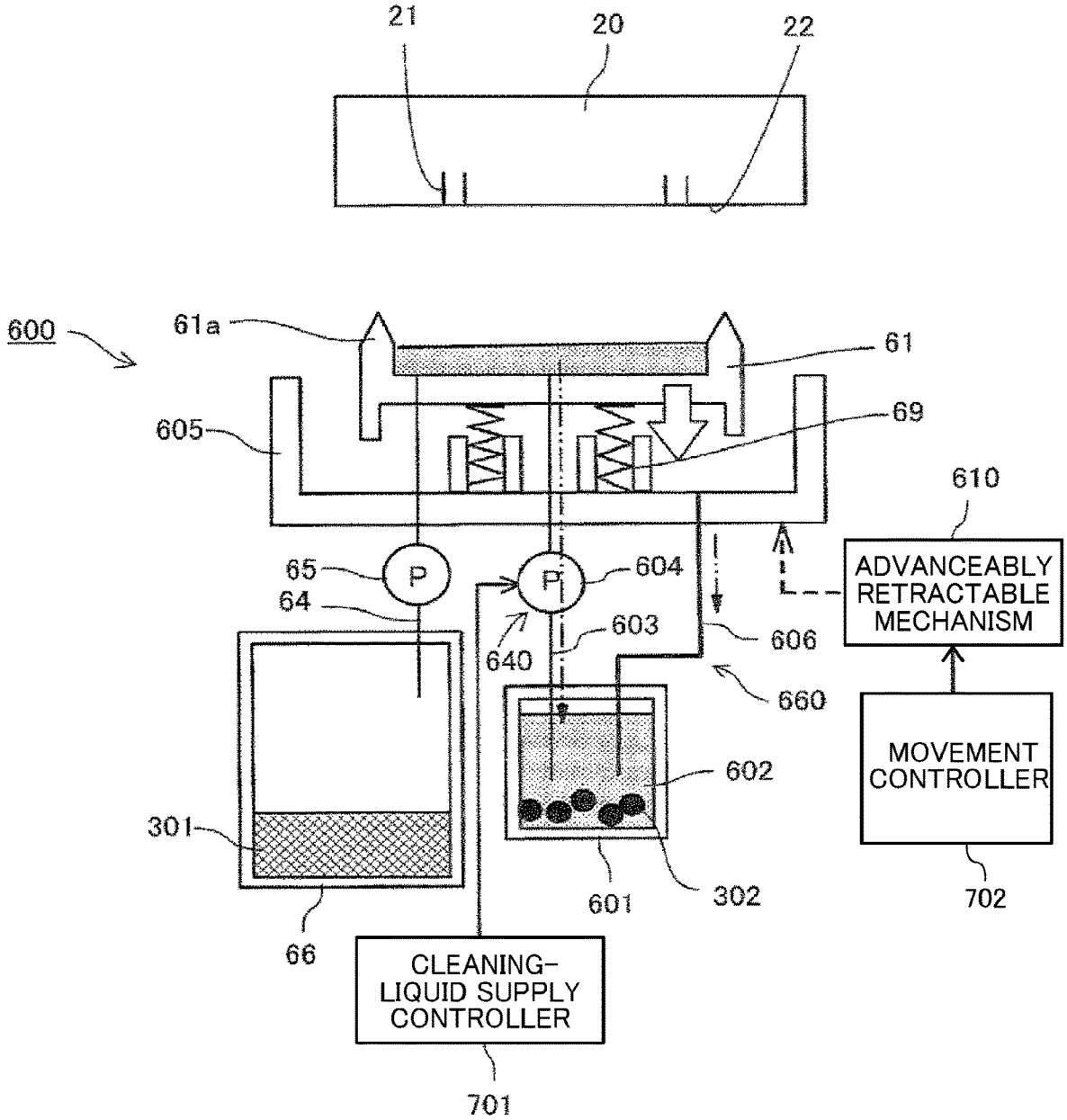
FIG. 10 is a schematic cross-sectional side view of the maintenance device illustrating the effect of the second embodiment.

As illustrated in FIG. 10, the cleaning liquid 602 containing the adhered substance 302 is received by the cleaning-liquid receptacle 605 and is collected to the cleaning-liquid storage 601 through the cleaning-liquid collection channel 606. The maintenance device 600 in the second embodiment includes the cleaning-liquid storage 601 below the cleaning-liquid receptacle 605 so that the cleaning liquid 602 in the cleaning-liquid receptacle 605 is collected to the cleaning-liquid storage 601 by the head difference between the cleaning-liquid receptacle 605 and the cleaning-liquid storage 601.

Further, a device such as a liquid feed pump may be added and arranged in the cleaning-liquid collection channel 606 to forcibly collect the cleaning liquid 602 from the cleaning-liquid receptacle 605 to the cleaning-liquid storage 601.

After the cleaning liquid 602 overflows from the cap 61, the cleaning-liquid supply controller 701 stops driving the liquid feed pump 604 at a required timing to stop supplying the cleaning liquid 602 to the cap 61.

Then, the cleaning-liquid supply controller 701 reversely drives the liquid feed pump 604 to reversely feed the cleaning liquid 602 remaining in the cap 61 to the cleaning-liquid storage 601.

The maintenance device 600 performs the cleaning operation to clean the contact part 61*a* of the cap 61 so that the maintenance device 600 can prevent the adhered substance 302 adhering to the contact part 61*a* of the cap 61 from solidifying and accumulating on the contact part 61*a*. Further, the maintenance device 600 in the second embodiment can also clean the nozzle surfaces 22 of the head 20.

Therefore, the maintenance device 600 can prevent the deposit of the adhered substance 302 remaining on the contact part 61*a* of the cap 61 from transferring to the nozzle surface 22 of the head 20. Thus, the maintenance device 600 can prevent a print surface of a recording medium from soiling by the adhered substance 302 transferred on the nozzle surface 22 of the head 20 when the printer 1 scans the head 20 for the print operation.

Further, the maintenance device 600 can prevent the adhered substance 302 from being sandwiched between the contact part 61*a* of the cap 61 and the nozzle surface 22 of the head 20. Thus, the maintenance device 600 can fully cap the nozzle surface 22 of the head 20 and prevent the cap 61 from deterioration of moisturizing performance and suction performance.

Thus, the maintenance device 600 can collect the cleaning liquid 602 used for cleaning the contact part 61*a* of the cap 61 so that the maintenance device 600 can reduce an amount of consumption of the cleaning liquid 602 for cleaning the cap 61.

Further, the maintenance device 600 does not discharge the cleaning liquid 602 used for cleaning the contact part 61*a* of the cap 61 to the waste-liquid storage 66 as it is as a waste liquid. Thus, the maintenance device 600 can reduce an amount of waste liquid stored in the waste-liquid storage 66 and lengthen life of the waste-liquid storage 66.

Further, as described above, the maintenance device 600 in the second embodiment moves the contact part 61*a* of the cap 61 close to the nozzle surface 22 of the head 20 to the gap G1 (see FIG. 9) at which the cleaning liquid 602 adheres to the nozzle surface 22 of the head 20 by surface tension to clean the contact part 61*a* of the cap 61.

Figure 11A:
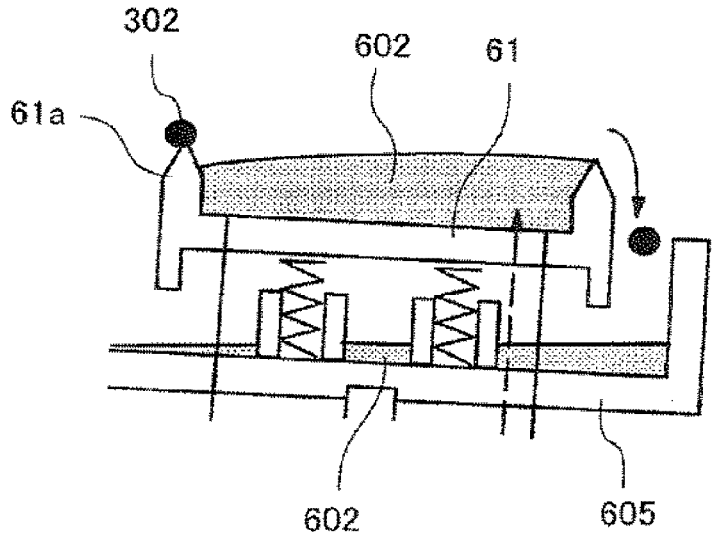
FIGS. 11A and 11B are schematic cross-sectional side viewed of the maintenance device illustrating the effect of the second embodiment.

Thus, the cleaning liquid 602 overflows substantially evenly from a periphery of the cap 61 even when the cap 61 is tilted as illustrated in FIG. 11A. Thus, the maintenance device 600 in the second embodiment can reduce uneven cleaning of the contact part 61*a* of the cap 61.

As illustrated in FIG. 11A, when the cap 61 is tilted, the cleaning liquid 602 supplied into the cap 61 overflows from the cap 61 such that the cleaning liquid 602 overflows from the cap 61 on a lower side (right side in FIG. 11A) of the cap 61, but the cleaning liquid 602 does not overflow from the cap 61 on a higher side (left side in FIG. 11A) of the cap 61.

Thus, the adhered substance 302 remains on the contact part 61*a* of the higher side (left side in FIG. 11A) of the cap 61.

Thus, the maintenance device 600 advances the cap 61 toward the nozzle surface 22 of the head 20 so that a distance between the contact part 61*a* of the cap 61 and the nozzle surface 22 of the head 20 as the opposing member becomes the gap G1.

Figure 11B:
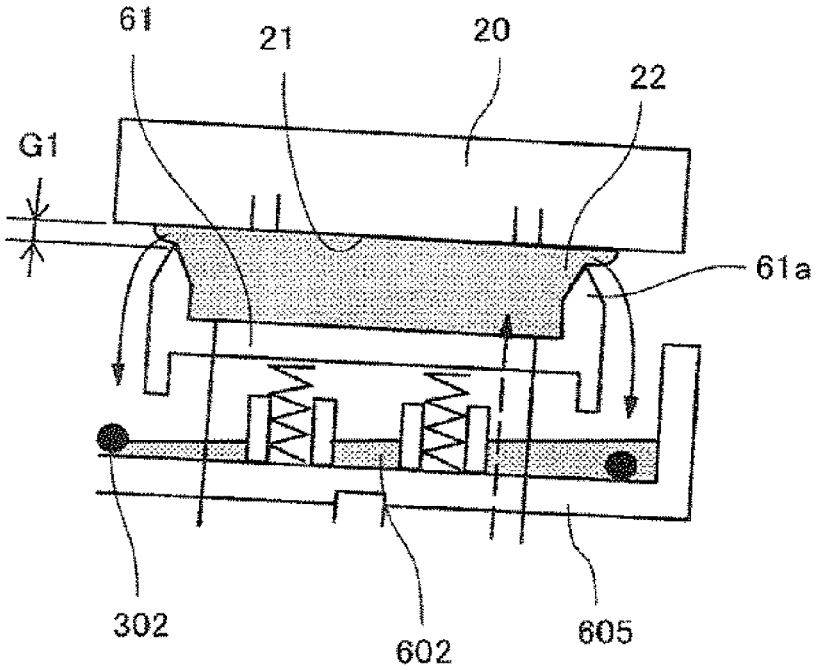

Thus, as illustrated in FIG. 11B, the cleaning liquid 602 overflows from the cap 61 while surface tension of the cleaning liquid 602 is generated between the nozzle surface 22 of the head 20 and the contact part 61*a* of the cap 61.

Therefore, the cleaning liquid 602 can overflow from the contact part 61*a* of the cap 61 substantially evenly. Further, the maintenance device 600 can also wash away dirt adhering to the nozzle surface 22 of the head 20.

The maintenance device 600 in the second embodiment includes the head 20 as the opposing member as an example. However, the maintenance device 600 may arrange and use the opposing members other than the head 20. Further, the maintenance device 600 in the second embodiment moves the cap 61 toward the head as the opposing member as an example.

However, the maintenance device 600 may also move the head 20 as the opposing member toward the cap 61. Thus, the maintenance device 600 may move the head 20 (opposing member) and the cap 61 relative to each other.

Next, a third embodiment of the present disclosure is described with reference to FIG. 12.

Figure 12:
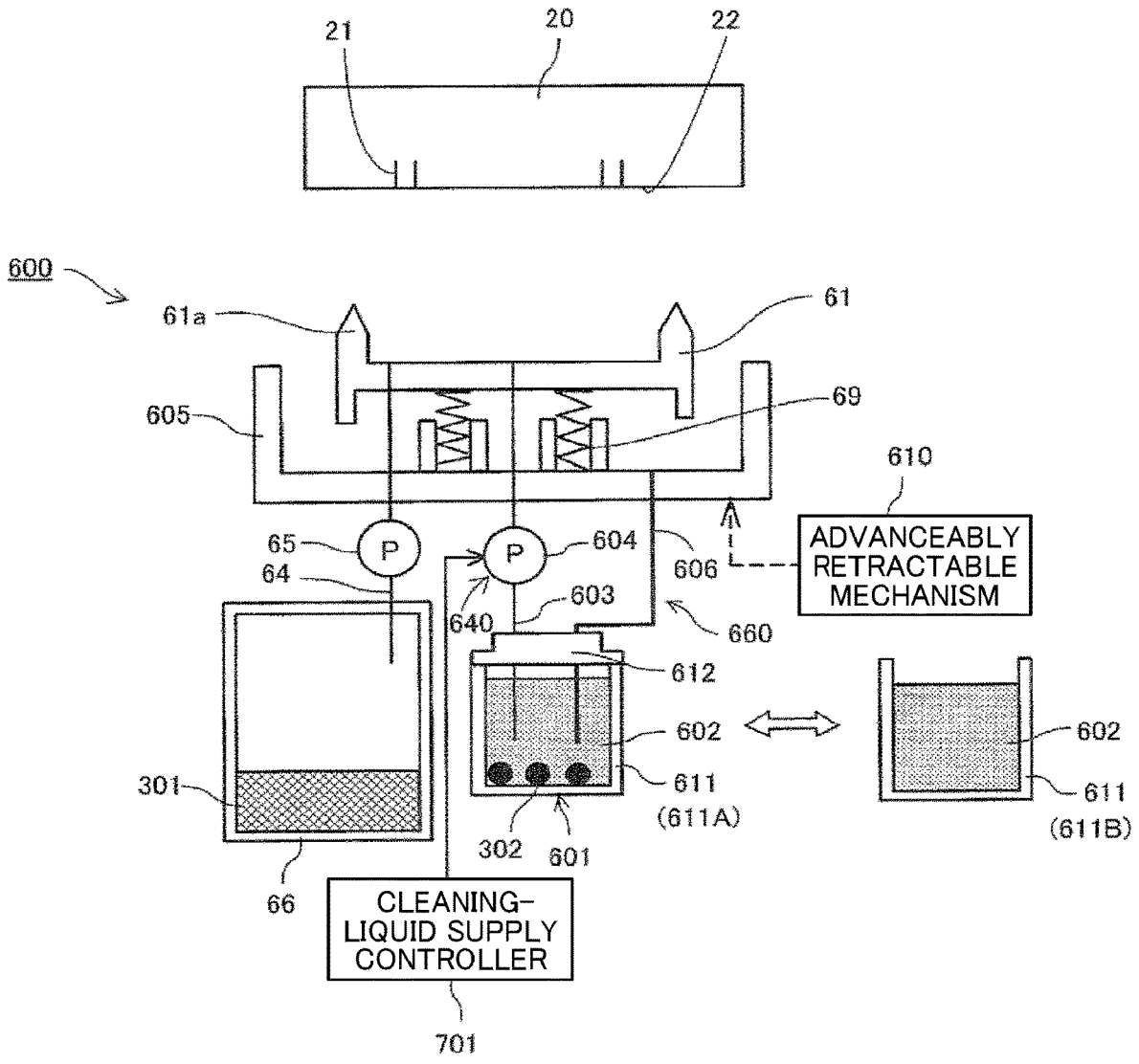
FIG. 12 is a schematic side view of the maintenance device according to a third embodiment of the present disclosure.

FIG. 12 is a schematic cross-sectional side view of the maintenance device 600 according to a third embodiment of the present disclosure.

The maintenance device 600 in the second embodiment includes the cleaning-liquid storage 601 replaceably attachable to an apparatus body of the printer 1. The cleaning-liquid storage 601 includes a container body 611 (bottle) and a lid 612 (bottle cap) detachably attached to the container body 611.

The cleaning-liquid supply channel 603 and the cleaning-liquid collection channel 606 are inserted into the container body 611 through the lid 612. Then, the lid 612 is removed from the container body 611 to replace the container body 611 containing the cleaning liquid 602.

Therefore, the container body 611A of the cleaning-liquid storage 601 containing large amount of collected (used) cleaning liquid 602 containing the adhered substance 302 is removed and replaced with the container body 611B containing unused cleaning liquid 602, for example.

Thus, the maintenance device 600 cam maintain the cleaning performance of the cleaning liquid 602 in the cleaning-liquid storage 601.

That is, the cleaning liquid 602 used for cleaning is collected and returned to the cleaning-liquid storage 601 for reuse. Thus, the adhered substance 302 collected together with the cleaning liquid 602 at the time of cleaning is gradually mixed to the cleaning liquid 602. Thus, the cleaning liquid 602 becomes dirty and the cleaning performance of the cleaning liquid 602 deteriorates.

Therefore, the cleaning-liquid storage 601 is replaceable to replace the cleaning liquid 602 so that the maintenance device 600 can maintain the cleaning performance of the cleaning liquid 602 in the cleaning-liquid storage 601.

Next, a fourth embodiment of the present disclosure is described with reference to FIG. 13.

Figure 13:
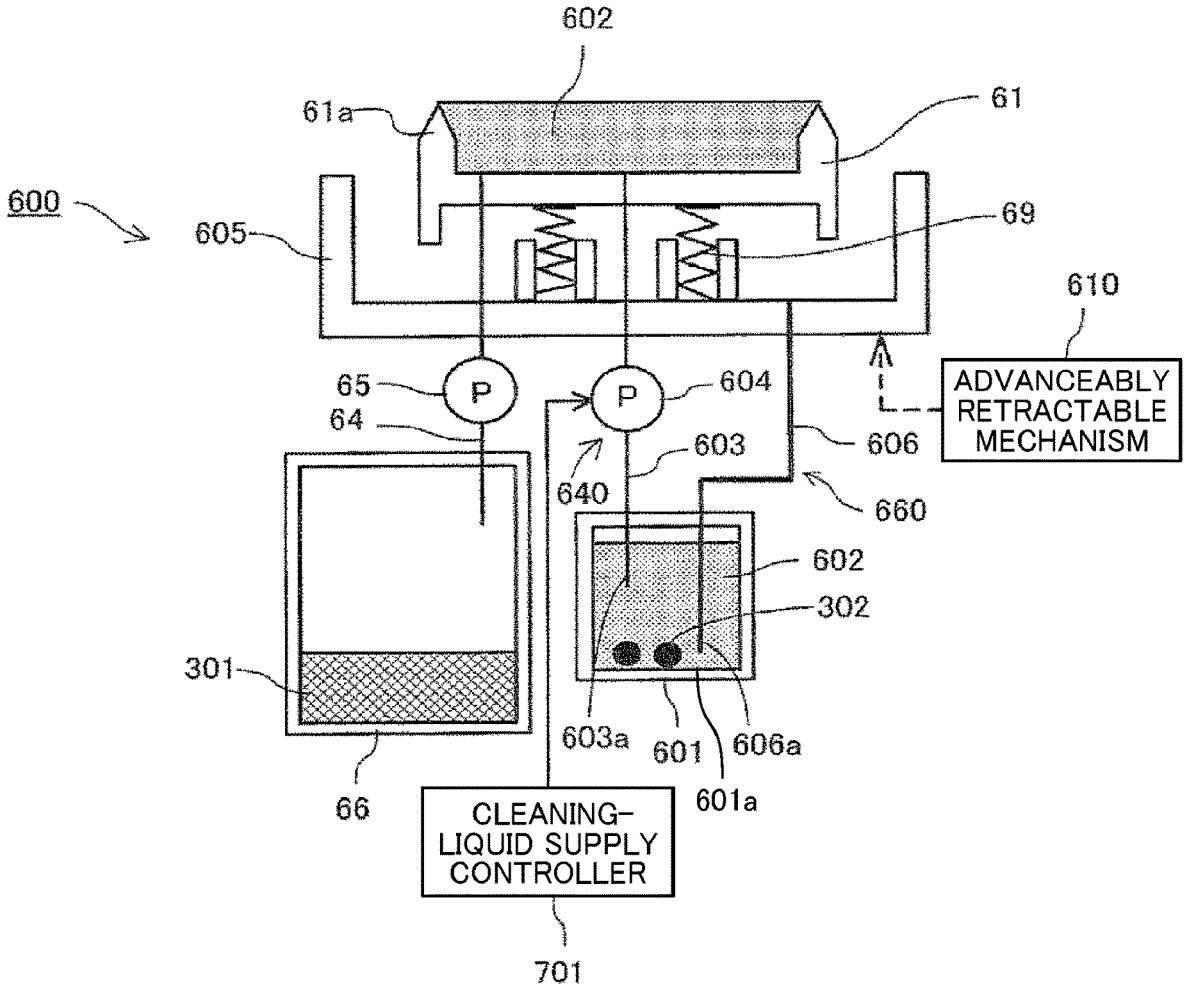
FIG. 13 is a schematic side view of the maintenance device according to a fourth embodiment of the present disclosure.

FIG. 13 is a schematic cross-sectional side view of the maintenance device 600 according to a fourth embodiment of the present disclosure.

The maintenance device 600 in the fourth embodiment includes the intake port 603*a* of the cleaning-liquid supply channel 603 in the cleaning-liquid storage 601.

A distance between the intake port 603*a* and the inner bottom 601*a* (see FIG. 1) of the cleaning-liquid storage 601 is larger than a distance between the discharge port 606*a* of the cleaning-liquid collection channel 606 and the inner bottom 601*a* of the cleaning-liquid storage 601. Thus, the intake port 603*a* is father from the inner bottom 601*a* than the discharge port 606*a*.

Thus, the maintenance device 600 can reduce an amount of the adhered substance 302 in the cleaning-liquid storage 601 to be sucked to the cleaning-liquid supply channel 603. The adhered substance 302 contained in the cleaning liquid 602 is returned to the cleaning-liquid storage 601 through the cleaning-liquid collection channel 606.

Next, a fifth embodiment of the present disclosure is described with reference to FIG. 14.

Figure 14:
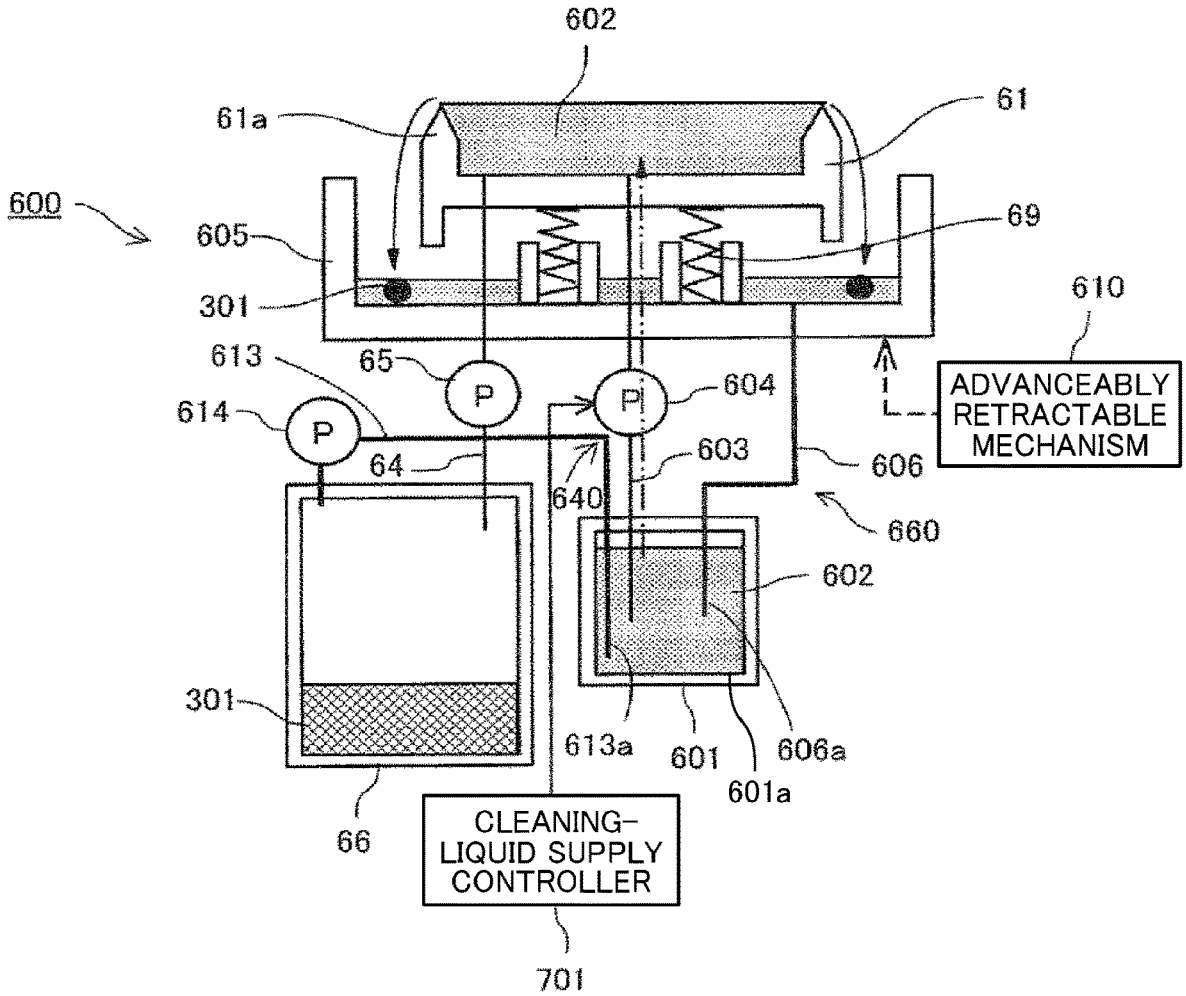
FIG. 14 is a schematic side view of the maintenance device according to a fifth embodiment of the present disclosure.

FIG. 14 is a schematic cross-sectional side view of the maintenance device 600 according to a fifth embodiment of the present disclosure.

The maintenance device 600 according to the fifth embodiment includes a transfer channel 613 to connect the cleaning-liquid storage 601 and the waste-liquid storage 66. The maintenance device 600 includes a transfer pump 614 in the transfer channel 613. The transfer pump 614 transfers (feeds) the cleaning liquid 602 from the cleaning-liquid storage 601 to the waste-liquid storage 66.

The transfer channel 613 is made of a tubular member having a diameter larger than a diameter of the cleaning-liquid collection channel 606. The transfer channel 613 and the transfer pump 614 together form a transfer device to feed the cleaning liquid 602 (second liquid) in a vicinity of an inner bottom 601*a* of the cleaning-liquid storage 601 to the waste-liquid storage 66.

Similarly, the transfer channel 613 includes an intake port 613*a* in a vicinity of the inner bottom 601*a* of the cleaning-liquid storage 601. The cleaning liquid 602 in the vicinity of the inner bottom 601*a* of the cleaning-liquid storage 601 (container) is fed and transferred to the waste-liquid storage 66.

Further, the intake port 613*a* of the transfer channel 613 is closer to the inner bottom 601*a* than the discharge port 606*a* of the cleaning-liquid collection channel 606 in the cleaning-liquid storage 601.

With such a configuration, the maintenance device 600 periodically drives the transfer pump 614 to transfer and discard the cleaning liquid 602 in the vicinity of the inner bottom 601*a* to the waste-liquid storage 66 together with the adhered substance 302. The cleaning liquid 602 in the vicinity of the inner bottom 601*a* is soiled by the adhered substance 302 collected to the cleaning-liquid storage 601.

The maintenance device 600 in the fifth embodiment includes the intake port 613*a* of the transfer channel 613 in the cleaning-liquid storage 601. A distance between the intake port 603*a* and the inner bottom 601*a* (see FIG. 1) of the cleaning-liquid storage 601 is larger than a distance between the discharge port 606*a* of the cleaning-liquid collection channel 606 and the inner bottom 601*a* of the cleaning-liquid storage 601. Thus, the intake port 613*a* is closer to the inner bottom 601*a* than the intake port 603*a* of the cleaning-liquid supply channel 603 in the cleaning-liquid storage 601.

With such a configuration, the maintenance device 600 periodically drives the transfer pump 614 to transfer and discard the cleaning liquid 602 in the vicinity of the inner bottom 601*a* to the waste-liquid storage 66 together with the adhered substance 302. The cleaning liquid 602 in the vicinity of the inner bottom 601*a* is soiled by the adhered substance 302 collected to the cleaning-liquid storage 601.

Thus, the maintenance device 600 can prevent the cleaning-liquid supply channel 603 from clogging due to an intake of the cleaning liquid 602 soiled by the adhered substance 302 from the intake port 603*a* of the cleaning-liquid supply channel 603.

Thus, the maintenance device 600 can maintain the cleaning liquid 602 in the cleaning-liquid storage 601 in a cleaned state. At the time of transferring the cleaning liquid 602 to the waste-liquid storage 66, unused cleaning liquid 602 is added to the cleaning-liquid storage 601 with disposal of the used cleaning liquid 602 containing the adhered substance 302 so that the cleaning performance of the cleaning liquid 602 can be maintained without replacing the cleaning-liquid storage 601 (or a container body).

Next, the maintenance device 600 according to a sixth embodiment of the present disclosure is described with reference to FIG. 15.

Figure 15:
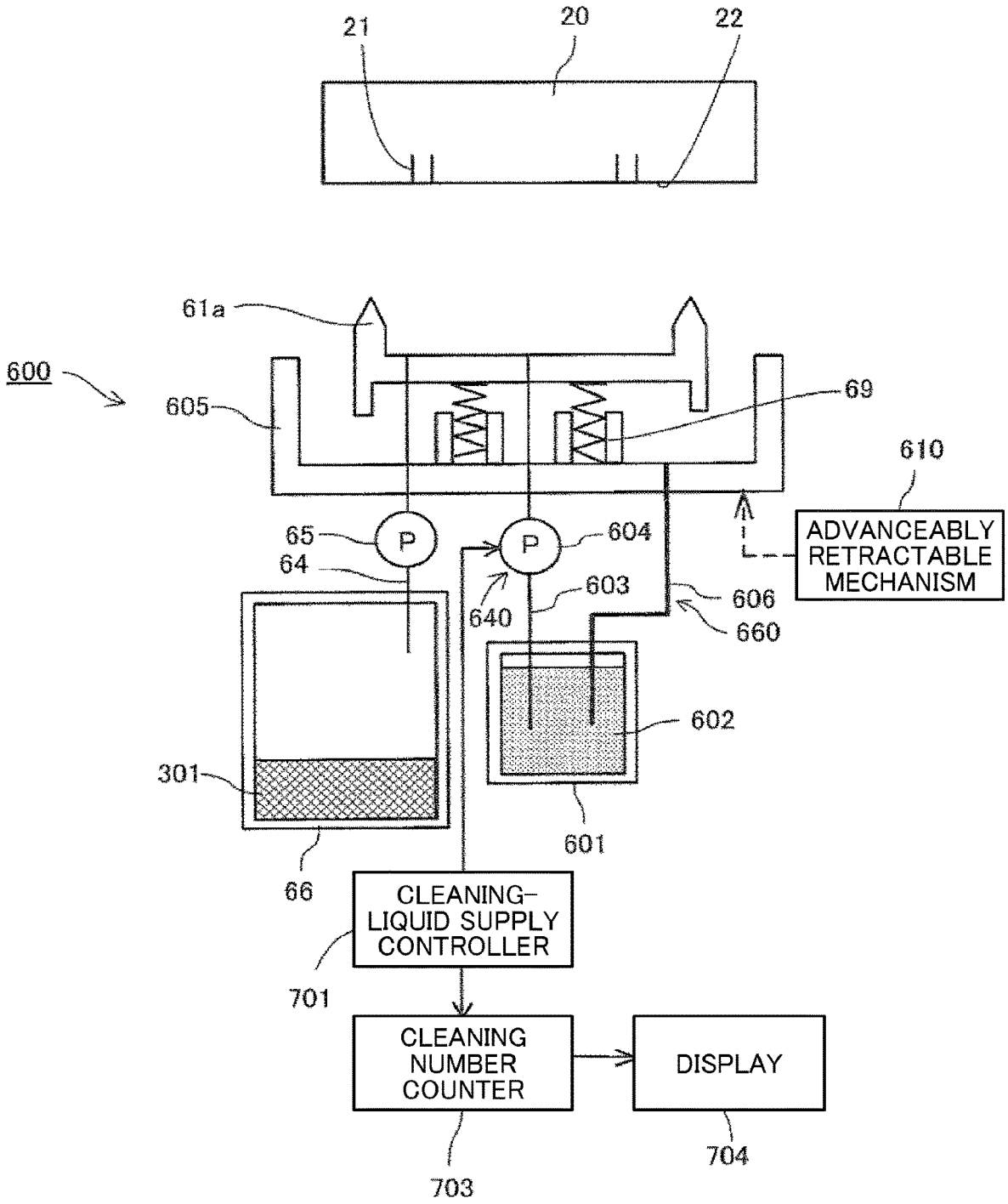
FIG. 15 is a schematic side view of the maintenance device according to a sixth embodiment of the present disclosure.

FIG. 15 is a schematic cross-sectional side view of the maintenance device 600 according to a sixth embodiment of the present disclosure.

The maintenance device 600 in the second embodiment includes a cleaning number counter 703 to count a number of times the cleaning operation to clean the cap 61 is performed. The cleaning number counter 703 counts, for example, a number of times the cleaning-liquid supply controller 701 drives the liquid feed pump 604 to feed the cleaning liquid 602 to the cap 61 as a cleaning number.

Then, the cleaning number counter 703 (counter) controls the display 704 to display a message prompting a replacement of the cleaning-liquid storage 601 when a counting value of the cleaning number counter 703 reaches a predetermined number of times (threshold value). The counting value is a number of times the liquid feed pump 604 supplies the cleaning liquid 602 (second liquid) to the cap 61.

That is, the cleaning number counter 703 (counter) controls the display 704 to display a message prompting a replacement of the cleaning-liquid storage 601 when the number becomes equal to or larger than a threshold value.

In the above case, the cleaning number counter 703 resets the counting value when the maintenance device 600 detects the replacement of the cleaning-liquid storage 601. Further, the maintenance device 600 determines that the cleaning-liquid storage 601 is replaced when an operation such as manually pressing a button of a "replacement confirmation button of the cleaning-liquid storage" displayed on an operation panel, for example.

Alternatively, the maintenance device 600 may include a detector to detect attachment and detachment of the cleaning-liquid storage 601 to the maintenance device 600. Thus, when the detector detects detachment (removal) of used cleaning-liquid storage 601 and attachment (setting) of new cleaning-liquid storage 601, the maintenance device determines that the cleaning-liquid storage 601 has been replaced.

Thus, the maintenance device 600 can maintain the cleaning performance of the cleaning liquid 602 in the cleaning-liquid storage 601.

Next, the maintenance device 600 according to a seventh embodiment of the present disclosure is described with reference to FIG. 16.

Figure 16:
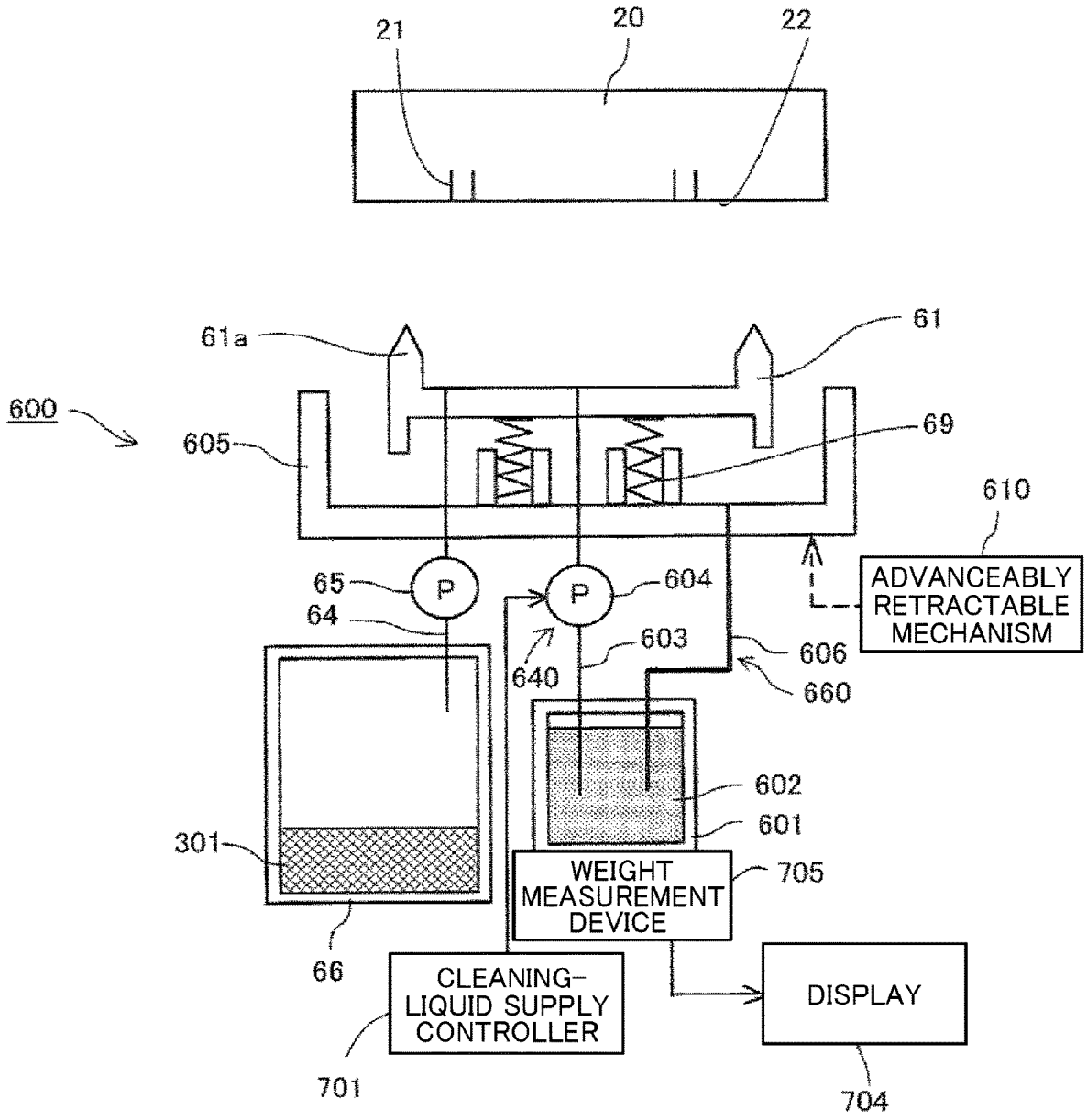
FIG. 16 is a schematic side view of the maintenance device according to a seventh embodiment of the present disclosure.

FIG. 16 is a schematic cross-sectional side view of the maintenance device 600 according to the seventh embodiment of the present disclosure.

The maintenance device 600 in the seventh embodiment includes a weight measurement device 705 to measure a weight of the cleaning-liquid storage 601. When the weight measurement device 705 detects that a measured value (measured weight) becomes equal to or larger than a predetermined weight (threshold value), the weight measurement device 705 controls the display 704 to display a message prompting the user to replace the cleaning-liquid storage 601.

Then, the weight measurement device 705 cancels the above message when the measured value (measured weight) becomes less than the predetermined weight (threshold value).

That is, a specific gravity of the cleaning liquid 602 is lighter than a specific gravity of the first liquid (ink) in general. For example, the specific gravity of the cleaning liquid 602 is about 1.0 to 1.05 g/cm3, and the specific gravity of the first liquid is about 1.1 to 1.2 g/cm3. Therefore, repetition of the cleaning operation gradually mixes the adhered substance 302 of the first liquid (ink) having a heavy specific gravity with the cleaning liquid 602 having a specific gravity lighter than the first liquid (ink) in the cleaning-liquid storage 601. Thus, the weight of the cleaning-liquid storage 601 during usage that stores the cleaning liquid 602 mixed with the adhered substance 302 gradually increases compared to the weight of an unused cleaning-liquid storage 601.

Therefore, when the weight of the cleaning-liquid storage 601 after the cleaning operation reaches the threshold value or more, the maintenance device 600 determines that the cleaning liquid 602 in the cleaning-liquid storage 601 is so dirty that the cleaning performance cannot be maintained.

Thus, the maintenance device 600 prompts the user to replace the cleaning-liquid storage 601. Thus, the maintenance device 600 can maintain the cleaning performance of the cleaning liquid 602 in the cleaning-liquid storage 601.

Next, the maintenance device 600 according to an eighth embodiment of the present disclosure is described with reference to FIG. 17.

Figure 17:
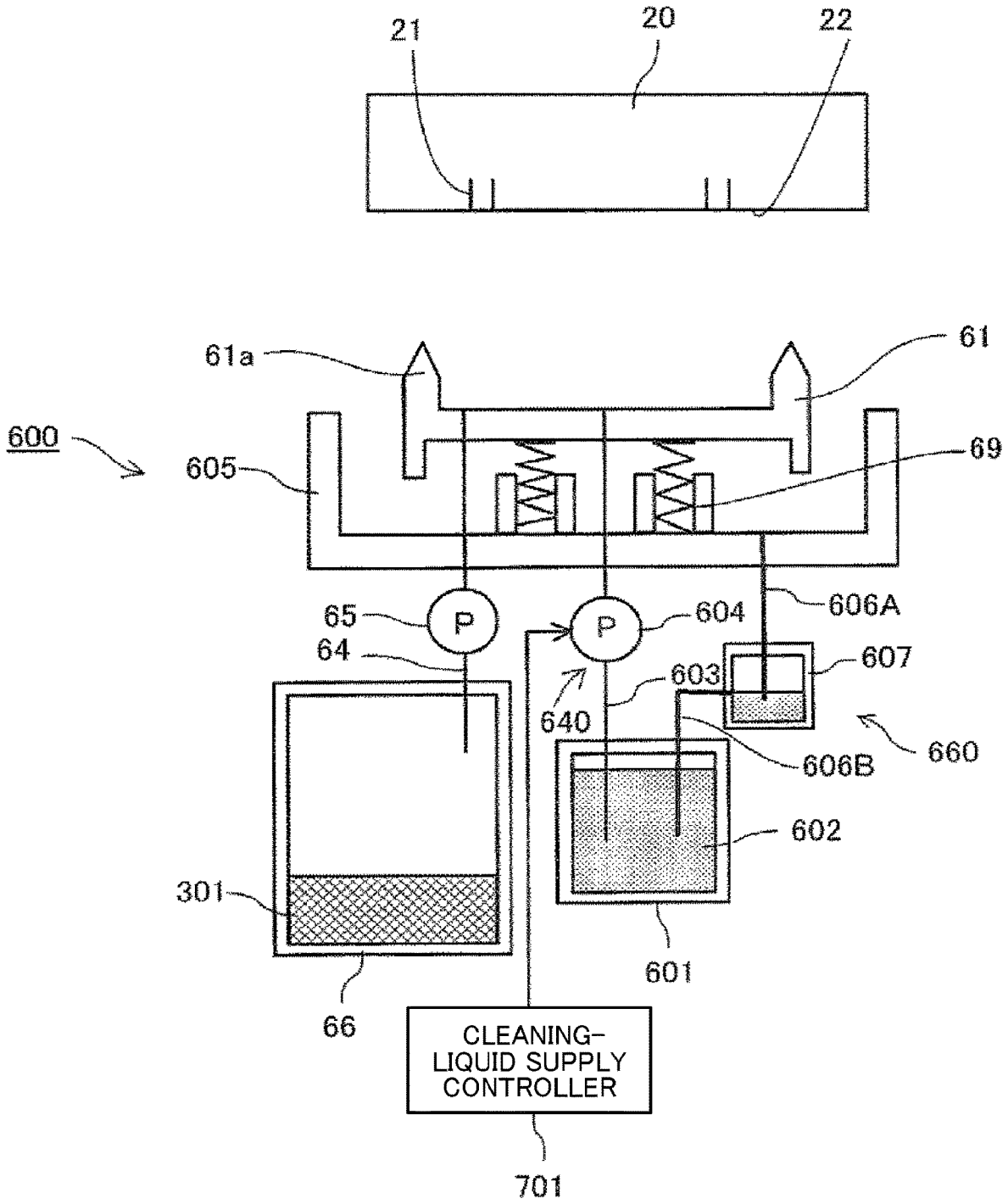
FIG. 17 is a schematic side view of the maintenance device according to an eighth embodiment of the present disclosure.

FIG. 17 is a schematic cross-sectional side view of the maintenance device 600 according to the eighth embodiment of the present disclosure.

The cleaning-liquid collection device 660 in the eighth embodiment includes a cleaning-liquid collection channel 606A communicating with the cleaning-liquid receptacle 605, an intermediate collection container 607 communicating with the cleaning-liquid collection channel 606, and a cleaning-liquid collection channel 606B connecting the intermediate collection container 607 and the cleaning-liquid storage 601.

A top end (right end in FIG. 17) of the cleaning-liquid collection channel 606B is arranged at a height at which a supernatant portion of the cleaning liquid 602 containing the adhered substance 302 collected in the intermediate collection container 607 can be further collected to the cleaning-liquid storage 601.

Thus, the supernatant portion of the cleaning liquid 602 in the intermediate collection container 607 is transferred to the cleaning-liquid storage 601, and the adhered substance 302 in the intermediate collection container 607 is remained in the intermediate collection container 607 without transferred to the cleaning-liquid storage 601.

Thus, the cleaning-liquid collection device 660 can reduce a speed of a progress of soiling of the cleaning liquid 602 stored in the cleaning-liquid storage 601. Thus, the intermediate collection container 607 is replaceable. Further, the cleaning-liquid collection device 660 may include a filter to remove the adhered substance 302 at a connection portion of the intermediate collection container 607 with the cleaning-liquid collection channel 606B.

Next, an example of a printer 1 serving as a liquid discharge apparatus according to a ninth embodiment is described with reference to FIGS. 18 to 20.

Figure 18:
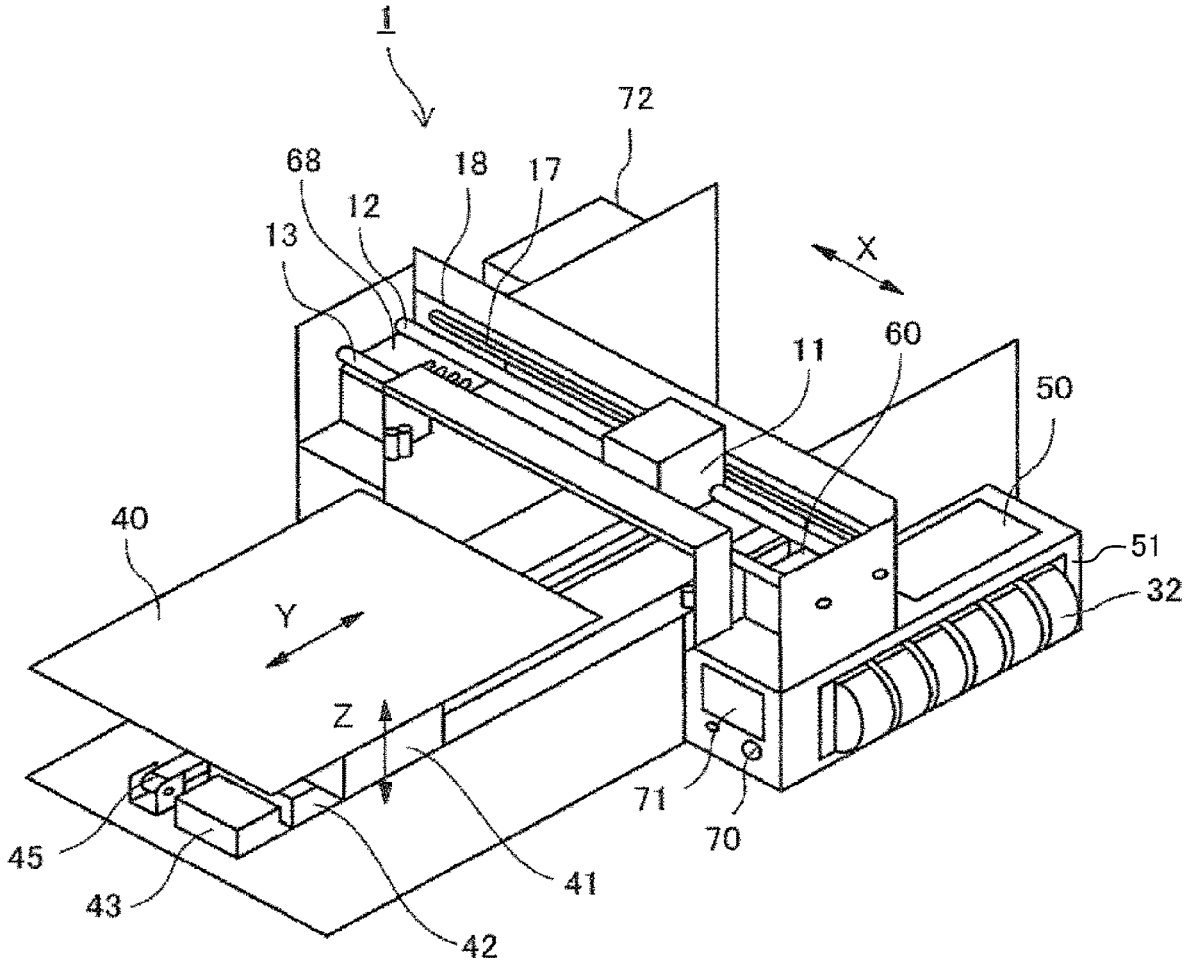
FIG. 18 is a schematic perspective view of a printer as a liquid discharge apparatus according to a ninth embodiment of the present disclosure.

FIG. 18 is a schematic perspective view of the printer 1 according to the ninth embodiment.

Figure 19:
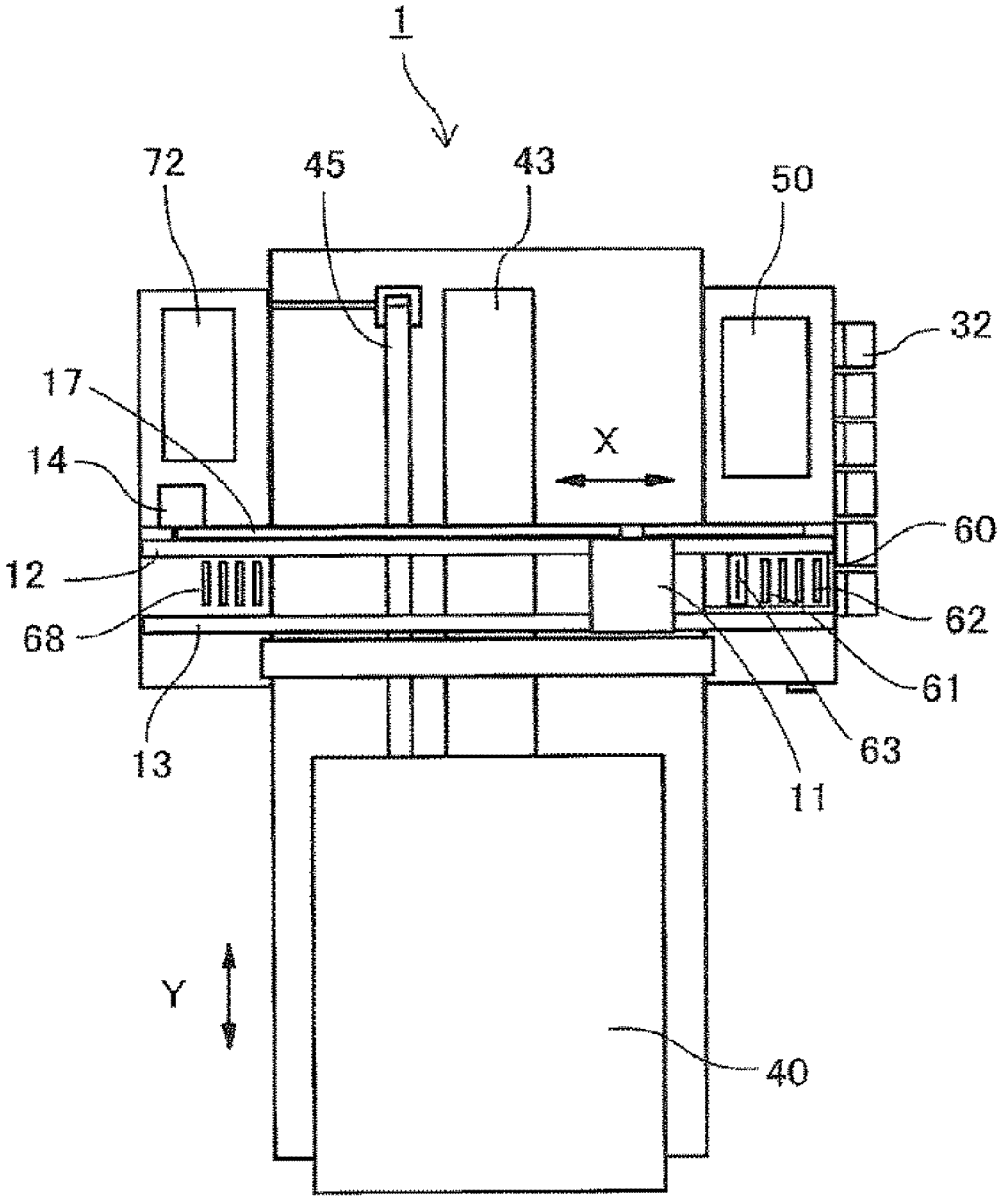
FIG. 19 is a schematic plan view of the printer as the liquid discharge apparatus of FIG. 18.

FIG. 19 is a schematic plan view of the printer 1 of FIG. 18.

Figure 20:
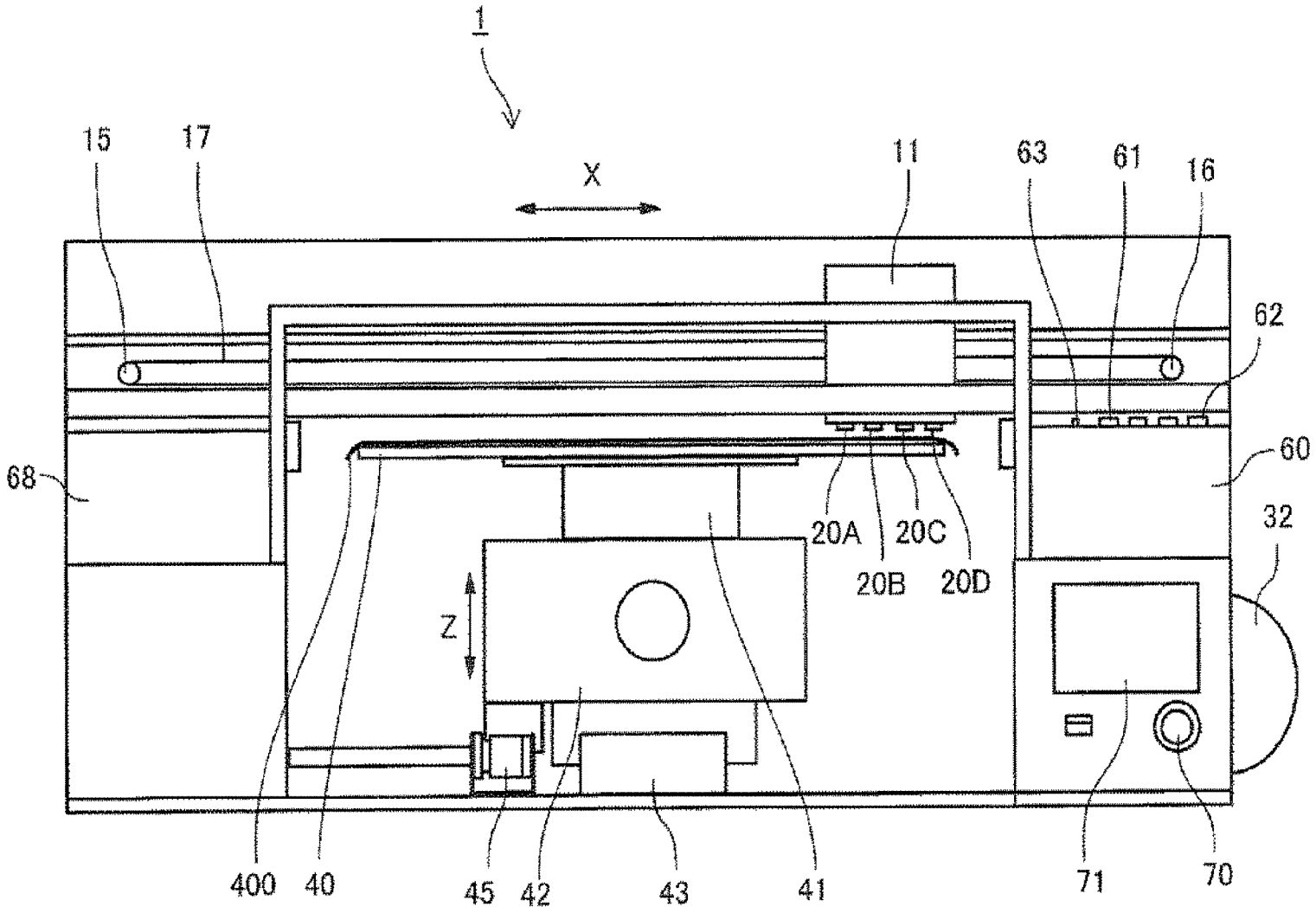
FIG. 20 is a schematic cross-sectional front view of the printer of FIG. 18.

FIG. 20 is a schematic cross-sectional front view of the printer 1 according to the ninth embodiment of the present disclosure.

The printer 1 is an apparatus that discharges liquid. The printer 1 includes a carriage 11 on which a plurality of heads 20A to 20D are mounted. The plurality of heads 20A to 20D are liquid dischargers to discharge liquid. Hereinafter, the plurality of heads 20A to 20D are collectively referred to as heads 20, unless distinguished.

The guides 12 and 13 hold the carriage 11 such that the carriage 11 is reciprocally movable in a main scanning direction indicated by arrow "X" in FIG. 18.

To move and scan the carriage 11 in the main scanning direction X, the carriage 11 is coupled to a timing belt 17 stretched between a drive pulley 15 rotated by a main scanning motor 14 and a driven pulley 16.

As the main scanning motor 14 drives and rotates the timing belt 17 through the drive pulley 15, the timing belt 17 reciprocally moves the carriage 11 in the main scanning direction X.

The printer 1 includes an encoder sheet 18 arranged along the main-scanning direction X. The encoder sheet 18 includes a slit periodically formed on the encoder sheet 18. The carriage 11 includes a reading sensor to read the slits in the encoder sheet 18. Thus, the printer 1 can detect a position of the carriage 11 in the main scanning direction X from a reading result of the reading sensor.

The printer 1 includes a controller board 50 that controls the head 20 to discharge an ink as a liquid from the head 20 at a timing when the carriage 11 is moved to a discharge position. A position of the carriage 11 is obtained from the reading result of the reading sensor of the carriage 11.

The printer 1 includes the heads 20 (20A to 20D) mounted on the carriage 11. Each head 20 has a nozzle array in which the nozzles 21 to discharge liquid are arranged on the nozzle surface 22.

Main tanks 32 that store, for example, liquid of each color of black (K), cyan (C), magenta (M), and yellow (Y) are detachably attached to a tank holder 51 in a body of the printer 1, as illustrated in FIGS. 18 and 19. The liquids in the main tanks 32 are fed to the heads 20 via supply channels and liquid feeders.

The printer 1 includes a platen 40 as a holder to hold a fabric 400 as a print target (liquid application target). The printer 1 includes an elevator 41 on which the platen 40 is mounted. A position (height) of the elevator 41 is adjustable in a vertical direction indicated by arrow "Z."

The printer 1 includes a slider 42 on which the elevator 41 of the platen 40 is mounted. The printer 1 includes a slider rail 43 on which the slider 42 is movably mounted. The slider rail 43 is extended along on a sub scanning direction indicated by arrow "Y in FIG. 18." The sub scanning direction Y is perpendicular to the main scanning direction X. Thus, the slider 42 moves along the slider rail 43 in the sub scanning direction Y.

The slider 42 is reciprocally movable in the sub scanning direction Y via the timing belt 45 by a sub scan drive mechanism. Reciprocal movement of the slider 42 in the sub scanning direction Y reciprocally moves the platen 40 in the sub scanning direction Y.

The printer 1 includes a maintenance unit 60 to maintain and recover a discharge function the head 20. The maintenance unit 60 is disposed on one side (right-side in FIG. 18) of the printer 1 in the main scanning direction X. The maintenance unit 60 includes the cap 61 (suction cap), a moisture-retention cap 62, and a wiper 63.

The cap 61 (suction cap) caps the nozzle surface 22 of the head 20. The moisture-retention cap 62 caps the nozzle surface 22 of the head 20 to keep moisture in the nozzles of the head 20. The wiper 63 wipes the nozzle surface 22 of the head 20.

The cap 61 (suction cap) is connected to a suction pump serving as a suction device. The maintenance device 600 includes the maintenance unit 60, the cleaning-liquid storage 601 as a storage described in each of the above embodiments, the cleaning-liquid receptacle 605, the cleaning-liquid collection device 660, and the like.

The printer 1 includes a discharge receptacle 68 on another end (left end in FIG. 18) of the printer 1 in the main scanning direction X. The controller board 50 controls the head 20 to discharge the liquid to the discharge receptacle 68 during printing to maintain and recover a discharge function of the head 20.

Further, the printer 1 includes a power button 70, an operation part 71, a power supply unit 72, and the like.

When the printer 1 prints on the fabric 400 (print target) such as a T-shirt, the fabric 400 is set on the platen 40. Then, the operation part 71 is operated to completely pulls the platen 40 in a rear direction (upper righthand in FIG. 18) of the printer 1 by moving the slider 42.

When the platen 40 is fully (completely) pulled inside the printer 1 (end of pull-in operation), the printer 1 becomes a print-data standby state. The printer 1 starts a print operation when the printer 1 receives print data from an external information processing device.

Alternatively, the printer 1 may select the print data by the operation part 71 to start the print operation when the print data is previously stored in the controller board 50.

When the printer 1 starts the print operation, the printer 1 moves the slider 42 to move the platen 40 to a printing start position at which the printer 1 starts the print operation. Then, the printer 1 moves the carriage 11 while discharging a liquid from the head 20 to perform one line of printing on the fabric 400.

When the printer one prints the one line, the printer one moves the slider 42 to move the platen 40 by one line on the fabric 400. The printer 1 intermittently repeats one scanning movement of the carriage 11 in the main scanning direction X and a movement of the slider 42 in the sub scanning direction Y to print an image on a desired region on the fabric 400. The printer 1 moves the platen 40 back to a front side (left side in FIG. 18) of the printer 1 to finish the print operation.

Although the printer 1 is described here as a printing device to apply a liquid to the fabric 400, a print target of the present embodiment is not limited to the fabric 400. The printing device may apply a liquid to a liquid application target other than the fabric 400 to print on the liquid application target.

The term "liquid discharge apparatus" used herein also represents an apparatus including the head or the liquid discharge device to drive the head to discharge liquid.

The liquid discharge apparatus may be, for example, an apparatus capable of discharging liquid to a material onto which liquid can adhere and an apparatus to discharge liquid toward gas or into liquid.

The "liquid discharge apparatus" may include devices to feed, convey, and eject the material on which liquid can adhere.

The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The liquid discharge apparatus is not limited to an apparatus to discharge liquid to visualize meaningful images, such as letters or figures.

For example, the liquid discharge apparatus may be an apparatus to form arbitrary images, such as arbitrary patterns, or fabricate three-dimensional images.

The above-described term "material onto which liquid can adhere" represents a material onto which liquid at least temporarily adheres, a material onto which liquid adheres and fixes, or a material onto which liquid adheres to permeate.

Examples of the "material on which liquid can adhere" include recording media, such as paper sheet, recording paper, recording sheet of paper, film, and cloth, electronic component, such as electronic substrate and piezoelectric element, media, such as powder layer, organ model, and testing cell, a car body, and construction materials.

The "material on which liquid can adhere" includes any material on which liquid can adhere, unless particularly limited.

Examples of the "material onto which liquid can adhere" include any materials on which liquid can adhere even temporarily, such as paper, thread, fiber, fabric, leather, metal, plastic, glass, wood, and ceramic.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation," "recording," "printing," "image printing," and "fabricating" used in the present embodiments may be used synonymously with each other.

Each of the functions of the described embodiments such as the cleaning-liquid supply controller 701, the movement controller 702, the cleaning number counter 703, the weight measurement device 705, and the display 704, for example, may be implemented by one or more processing circuits or circuitry. Processing circuitry includes a programmed processor, as a processor includes circuitry.

A processing circuit also includes devices such as an application specific integrated circuit (ASIC), digital signal processor (DSP), field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A maintenance device configured to maintain a head configured to discharge a first liquid, the maintenance device comprising:

a cap to contact a nozzle surface of the head;

a storage to store a second liquid to be supplied into the cap;

a supply to supply the second liquid into the cap;

a receptacle to receive the second liquid supplied into and overflown from the cap; and a collector to collect the second liquid received by the receptacle and to return the second liquid received by the receptacle to the storage.

2. The maintenance device according to claim 1, further comprising:

a mover to advance the cap toward and retract the cap from the nozzle surface of the head; and circuitry configured to control the mover to advance the cap close to the nozzle surface of the head with a predetermined gap.

3. The maintenance device according to claim 2, wherein the predetermined gap is set to a distance at which a surface tension of the second liquid is generated between the cap and the nozzle surface of the head when the second liquid is supplied to the cap from the storage, an amount of the second liquid supplied is larger than an inner volume of the cap.

4. The maintenance device according to claim 1, wherein the collector includes a collection channel connecting the receptacle and the storage.

5. The maintenance device according to claim 4, wherein the collection channel includes a discharge port from which the second liquid received from the receptacle is discharged to the storage, and the discharge port is separated from an inner bottom of the storage.

6. The maintenance device according to claim 5, wherein the supply includes a supply channel connecting the storage and the cap, the supply channel includes an intake port from which the second liquid in the storage is taken in, and the intake port is separated from the inner bottom of the storage.

7. The maintenance device according to claim 1, further comprising:

a waste-liquid storage to store a waste liquid; and a transferer to transfer the second liquid in a vicinity of an inner bottom of the storage to the waste-liquid storage.

8. A liquid discharge apparatus comprising:

a head to discharge a first liquid; and the maintenance device according to claim 1 to maintain the head.

9. The liquid discharge apparatus according to claim 8, wherein the storage is replaceably attachable to the maintenance device.

10. The liquid discharge apparatus according to claim 9, further comprising:

a counter to count a number of times of supplying the second liquid to the cap; and a display, wherein the counter is to control the display to display a message prompting a replacement of the storage when the number becomes equal to or larger than a threshold value.

11. The liquid discharge apparatus according to claim 9, further comprising:

a scale to measure a weight of the storage; and a display, wherein the scale is to control the display to display a message prompting a replacement of the storage when the weight becomes equal to or larger than a threshold value.

12. A maintenance device configured to maintain a head configured to discharge a first liquid, the maintenance device comprising:

a cap to contact a nozzle surface of the head;

a storage to store a second liquid to be supplied into the cap;

a supply to supply the second liquid into the cap;

a receptacle to receive the second liquid supplied into and overflown from the cap;

a collector to collect the second liquid received by the receptacle;

a mover to advance the cap toward and retract the cap from the nozzle surface of the head; and circuitry configured to control the mover to advance the cap close to the nozzle surface of the head with a predetermined gap.

13. A maintenance device configured to maintain a head configured to discharge a first liquid, the maintenance device comprising:

a cap to contact a nozzle surface of the head;

a storage to store a second liquid to be supplied into the cap;

a supply to supply the second liquid into the cap;

a receptacle to receive the second liquid supplied into and overflown from the cap;

a collector to collect the second liquid received by the receptacle;

a counter to count a number of times of supplying the second liquid to the cap; and a display, wherein the counter is to control the display to display a message prompting a replacement of the storage when the number becomes equal to or larger than a threshold value.

* * * * *